US012351413B2

(12) United States Patent
Kosuge et al.

(10) Patent No.: US 12,351,413 B2
(45) Date of Patent: Jul. 8, 2025

(54) POST-PROCESSING DEVICE

(71) Applicant: SEIKO EPSON CORPORATION, Tokyo (JP)

(72) Inventors: Hiroyuki Kosuge, Matsumoto (JP); Chiaki Shimada, Shiojiri (JP); Kenji Uchibori, Shiojiri (JP); Naoki Uemura, Suwa (JP); Shun Hara, Matsumoto (JP); Hirohisa Kodaira, Shiojiri (JP); Riku Maeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 17/664,457

(22) Filed: May 23, 2022

(65) Prior Publication Data

US 2022/0380162 A1 Dec. 1, 2022

(30) Foreign Application Priority Data

May 26, 2021 (JP) ..... 2021-088151

(51) Int. Cl.
*B65H 31/02* (2006.01)
*B65H 31/36* (2006.01)

(52) U.S. Cl.
CPC ..... *B65H 31/02* (2013.01); *B65H 31/36* (2013.01); *B65H 2301/4213* (2013.01);
(Continued)

(58) Field of Classification Search
CPC ..... B65H 9/004; B65H 9/10; B65H 9/103; B65H 9/106; B65H 31/02; B65H 31/36;
(Continued)

(56) References Cited

U.S. PATENT DOCUMENTS 8,556,258 B2 10/2013 Mizubata et al.
11,427,429 B2 8/2022 Shiobara et al.
(Continued)

FOREIGN PATENT DOCUMENTS

JP 2009-249098 A 10/2009
JP 2013-082528 5/2013
JP 2018-154413 A 10/2018
JP 2020-050470 4/2020

OTHER PUBLICATIONS

Merriam-Webster dictionary, Jun. 4, 2024, p. 1 (Year: 2024).*

*Primary Examiner* — Prasad V Gokhale
(74) *Attorney, Agent, or Firm* — WORKMAN NYDEGGER

(57) ABSTRACT

A post-processing device includes a processing tray, an aligning plate, a transport section, a feeding section, and a pressing section. A sheet before being subjected to stapling processing by a stapler is to be mounted on the processing tray. The aligning plate aligns ends of a plurality of sheets. The transport section transports the sheet toward the aligning plate. The feeding section is provided between the transport section and the aligning plate and feeds the sheet in a transport direction. The pressing section is provided between the transport section and the aligning plate and applies, to the sheet, a pressing force having a component in a direction opposite from the transport direction. Further, the pressing section applies the pressing force to the sheet before the feeding section applies a feeding force to the sheet.

19 Claims, 19 Drawing Sheets

(52) U.S. Cl.
CPC ..... *B65H 2404/1114* (2013.01); *B65H 2404/653* (2013.01); *B65H 2405/11151* (2013.01); *B65H 2801/27* (2013.01)

(58) Field of Classification Search
CPC ..... B65H 2404/1114; B65H 2404/531; B65H 2404/5311; B65H 2404/65; B65H 2404/651; B65H 2404/652; B65H 2404/653; B65H 2404/654; B65H 2301/4212; B65H 2301/4213; B65H 2405/11151; B65H 2801/27
See application file for complete search history.

(56) References Cited

U.S. PATENT DOCUMENTS

| | | | | |
|---|---|---|---|---|
| 11,738,965 | B2 | 8/2023 | Shiobara et al. | |
| 2005/0156373 | A1* | 7/2005 | Konagaya | B65H 9/06 271/226 |
| 2009/0250861 | A1* | 10/2009 | Kimura | B65H 31/3027 270/58.08 |
| 2013/0140765 | A1 | 6/2013 | Mizubata et al. | |
| 2013/0207334 | A1* | 8/2013 | Awano | B65H 31/02 270/58.17 |
| 2016/0355364 | A1* | 12/2016 | Shibata | G03G 15/6541 |
| 2018/0265323 | A1 | 9/2018 | Kim et al. | |
| 2020/0095085 | A1 | 3/2020 | Shiobara et al. | |
| 2022/0332535 | A1 | 10/2022 | Shiobara et al. | |

* cited by examiner

POST-PROCESSING DEVICE

The present application is based on, and claims priority from JP Application Serial Number 2021-088151, filed May 26, 2021, the disclosure of which is hereby incorporated by reference herein in its entirety.

BACKGROUND

1. Technical Field

The present disclosure relates to a post-processing device.

2. Related Art

A post-processing device according to JP-A-2018-154413 includes a compilation tray in which a plurality of printing sheets are stored, an end guide that aligns trailing ends of printing sheets in a bundle stored in the compilation tray, sub-paddles that transport a printing sheet to the compilation tray, and main paddles that transport the printing sheet, which is transported by the sub-paddles, until the printing sheet reaches the end guide serving as an aligning section.

According to the configuration of JP-A-2018-154413, a portion of a medium fed to a mounting section upon rotation of a transport section, such as the sub-paddles, may bulge in a direction away from the mounting section due to difficulty in resisting a transporting force applied by the transport section. When the medium bulges in a feeding section, such as the main paddles, an area in which the feeding section comes into contact with the medium increases compared with when the medium does not bulge, and an excessive transporting force may thus be applied to the medium, which is transported to the aligning section.

SUMMARY

A post-processing device according to the disclosure includes a mounting section on which a medium before being subjected to post-processing by a post-processing section is to be mounted, an aligning section that aligns ends of a plurality of media stacked on the mounting section, a transport section that transports the medium on the mounting section toward the aligning section in a transport direction, a feeding section that is provided between the transport section and the aligning section and feeds the medium in the transport direction, and a pressing section that is provided between the transport section and the aligning section, applies, to the medium, a pressing force having a component in a direction opposite from the transport direction, and applies the pressing force to the medium before the feeding section applies a feeding force to the medium.

DESCRIPTION OF EXEMPLARY EMBODIMENTS

Figure 1:
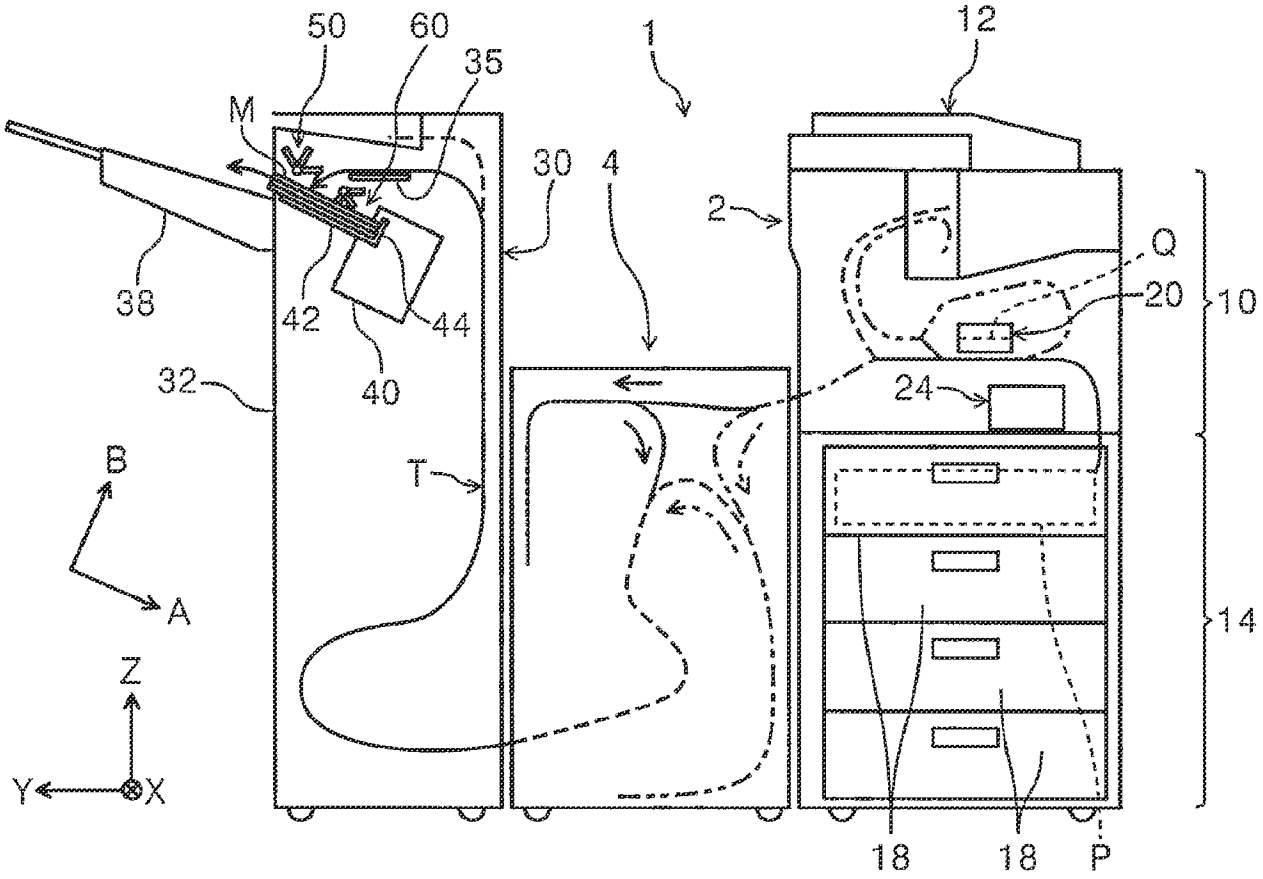
FIG. 1 illustrates an overall configuration of a recording system according to Embodiment 1.

The disclosure will be schematically described below.

A post-processing device according to a first aspect includes a mounting section on which a medium before being subjected to post-processing by a post-processing section is mounted, an aligning section that aligns ends of a plurality of media stacked on the mounting section, a transport section that transports the medium on the mounting section toward the aligning section in a transport direction, a feeding section that is provided between the transport section and the aligning section and feeds the medium in the transport direction, and a pressing section that is provided between the transport section and the aligning section, applies, to the medium, a pressing force having a component in a direction opposite from the transport direction, and applies the pressing force to the medium before the feeding section applies a feeding force to the medium.

According to the first aspect, the transport section transports the medium on the mounting section toward the aligning section. A downstream end of the medium in the transport direction, being transported in the transport direction by the transport section, reaches the aligning section. At this time, when the transporting force is applied to the medium by the transport section, a portion of the medium may be in a state of bulging in a direction away from the mounting section.

Here, the pressing section applies the pressing force to the medium before the feeding section applies the feeding force to the medium. When the medium receives from the pressing section the pressing force having the component in the direction opposite from the transport direction, a bulge is reduced or eliminated. The medium the bulge of which is reduced or eliminated is fed in the transport direction by the feeding section. The downstream end of the medium in the transport direction is then aligned by the aligning section.

In this manner, when the bulge of the medium is suppressed, an area in which the feeding section comes into contact with the medium is able to be reduced, and it is thus possible to suppress an excessive transporting force being applied from the feeding section to the medium.

In the post-processing device according to a second aspect, the feeding section of the first aspect includes a rotational shaft that extends in a medium-width direction intersecting the transport direction, and the pressing section of the first aspect applies the pressing force to a portion of an upper medium uppermost in a stacking direction of the plurality of media, the portion being located below the rotational shaft in the stacking direction.

The upper medium is located above the mounting section and below the rotational shaft in the stacking direction.

Here, according to the present aspect, the pressing section applies the pressing force to the portion of the upper medium, which is located below the rotational shaft in the stacking direction. As a result, it is possible to suppress the bulge of the upper medium before an increase in the bulge, compared with a configuration in which the pressing force is applied to a portion of the upper medium, which is located above the rotational shaft.

In the post-processing device according to a third aspect, at least a portion of a second region of the medium, in which the pressing force acts, and at least a portion of a first region of the medium, in which the feeding force acts, are arranged side by side in the medium-width direction when viewed from top to bottom in the stacking direction, in the second aspect.

According to the present aspect, a position at which the pressing section is in contact with the medium and a position at which the feeding section is in contact with the medium are substantially the same in the transport direction. Thus, since the feeding section comes into contact with the medium in a short time after the bulge has been reduced by being pressed by the pressing section, it is possible to suppress the medium which has been pressed by the pressing section largely bulging again.

In the post-processing device according to a fourth aspect, the feeding section of the second or third aspect includes a first blade section that extends from an outer circumferential surface of the rotational shaft, the pressing section of the second or third aspect includes a second blade section that extends from the outer circumferential surface of the rotational shaft, and a second distance from a rotational center of the rotational shaft to a tip end of the second blade section is less than a first distance from the rotational center to a tip end of the first blade section when viewed in the medium-width direction.

According to the present aspect, when the second distance is less than the first distance, the feeding force applied to the medium by the pressing section is able to be less than the feeding force applied to the medium by the feeding section, and it is thus possible to suppress a load more than necessary being applied from the pressing section to the medium.

Note that, forces applied to the medium by the pressing section are distinguished such that a force having the component in the direction opposite from the transport direction is the pressing force and a force having a component in the transport direction is the feeding force.

In the post-processing device according to a fifth aspect, the pressing section of the fourth aspect performs a pressing operation of applying the pressing force to the medium by being rotated in a first direction when viewed in the medium-width direction and retreats from the medium by being rotated in a second direction opposite from the first direction after the pressing operation and before the feeding section applies the feeding force to the medium.

According to the present aspect, the pressing section rotates in the first direction and applies the pressing force to the medium to thereby suppress an increase in the bulge of the medium. In a state in which an increase in the bulge of the medium is suppressed, the pressing section rotates in the second direction and thereby retreats from the medium. Accordingly, the feeding force applied to the medium by the pressing section to be unnecessarily added to the transporting force for the medium is suppressed compared with a configuration in which the pressing section continues to rotate in the first direction, thus making it possible to suppress an excessive increase in the transporting force being applied to the medium by the feeding section.

In the post-processing device according to a sixth aspect, a second frictional coefficient at a position at which the pressing section of any one of the second to fifth aspects is in contact with the medium is lower than a first frictional coefficient at a position at which the feeding section of any one of the second to fifth aspects is in contact with the medium.

According to the present aspect, when the second frictional coefficient is lower than the first frictional coefficient, the feeding force applied to the medium by the pressing section is less than the feeding force applied to the medium by the feeding section. As a result, it is possible to suppress an unnecessary load being applied to the medium when the feeding section feeds the medium.

In the post-processing device according to a seventh aspect, a second elastic modulus of the pressing section of any one of the second to fifth aspects is lower than a first elastic modulus of the feeding section of any one of the second to fifth aspects.

According to the present aspect, when the second elastic modulus is lower than the first elastic modulus, the feeding force applied to the medium by the pressing section is less than the feeding force applied to the medium by the feeding section. As a result, it is possible to suppress an unnecessary load being applied to the medium when the feeding section feeds the medium.

In the post-processing device according to an eighth aspect, the feeding section of any one of the first to seventh aspects performs a feeding operation for the medium in a state in which the pressing section of any one of the first to seventh aspects applies the pressing force to the medium.

According to the present aspect, since the feeding section performs the feeding operation for the medium in a state in which the pressing section suppresses the bulge of the medium, it is possible to suppress an excessive transporting force being applied to the medium compared with a configuration in which the feeding section performs the feeding operation for the medium after the pressing section separates from the medium.

In the post-processing device according to a ninth aspect, the transport section of any one of the first to eighth aspects is configured to switch between a contact state in which the transport section is in contact with the medium and a retreat state in which the transport section is retreated from the medium, and the pressing section of any one of the first to eighth aspects applies the pressing force to the medium when the transport section is in the retreat state.

When the transport section continuously applies the transporting force to the medium, the bulge of the medium may become large.

Here, according to the present aspect, when the pressing section applies the pressing force to the medium when the transport section is in the retreat state of being retreated from the medium, it is possible to apply the pressing force to the medium while suppressing the bulge of the medium. As a result, it is possible to reduce the pressing force required to suppress the bulge of the medium compared with a configuration in which the pressing force is applied to the medium in a state in which the transport section applies the transporting force to the medium.

A post-processing device according to a tenth aspect includes a mounting section on which a medium before being subjected to post-processing by a post-processing section is to be mounted, an aligning section that aligns ends of a plurality of media stacked on the mounting section, a transport section that transports the medium on the mounting section toward the aligning section in a transport direction, a feeding section that is provided between the transport section and the aligning section and feeds the medium in the transport direction by rotating about a rotational shaft, and a pressing section that is provided between the transport section and the aligning section and, by rotating about the rotational shaft in a rotational direction identical to a rotational direction of the feeding section, applies, to the medium, a pressing force having a component in a direction opposite from the transport direction, in which the pressing section is provided at a position preceding the feeding section in the rotational direction.

According to the tenth aspect, the transport section transports the medium on the mounting section toward the aligning section. A downstream end of the medium in the transport direction, being transported in the transport direction by the transport section, reaches the aligning section. At this time, when the transport section applies the transporting force to the medium, a portion of the medium may be in a state of bulging in a direction away from the mounting section.

Here, the pressing section rotates about the rotational shaft of the feeding section. The pressing section is provided at a position preceding the feeding section in the rotational direction of the feeding section. Further, the pressing section applies the pressing force having the component in the direction opposite from the transport direction to the medium.

Thus, the bulge of the medium is reduced or eliminated. The medium the bulge of which is reduced or eliminated is fed in the transport direction by the feeding section. The downstream end of the medium in the transport direction is then aligned by the aligning section.

In this manner, when the bulge of the medium is suppressed, an area in which the feeding section comes into contact with the medium is able to be reduced, thus making it possible to suppress an excessive transporting force being applied from the feeding section to the medium.

Embodiment 1

A post-processing device 30 and a recording system 1 of Embodiment 1 will be specifically described below as an example of the disclosure.

FIG. 1 illustrates the recording system 1, which is an example of a recording apparatus. The recording system 1 is constituted by an ink jet apparatus that ejects ink Q, which is an example of a liquid, onto a sheet P, which is an example of a medium, to perform recording. Note that the X-Y-Z coordinate system illustrated in each of the drawings is an orthogonal coordinate system.

The X direction is an example of a medium-width direction and an apparatus depth direction and is a horizontal direction. The tail of an arrow indicating the X direction corresponds to the −X direction, and the tip of the arrow indicating the X direction corresponds to the +X direction.

The Y direction is an example of an apparatus width direction and is a horizontal direction. The tip of an arrow indicating the Y direction corresponds to the +Y direction, and the tail of the arrow indicating the Y direction corresponds to the −Y direction.

The Z direction is an example of an apparatus height direction and is a direction orthogonal to both the X direction and the Y direction. The tip of an arrow indicating the Z direction corresponds to the +Z direction, and the tail of the arrow indicating the Z direction corresponds to the −Z direction. In the following direction, the +Z direction may be referred to as "above", and the −Z direction may be referred to as "below".

Direction A intersects the Y direction when viewed in the X direction and is a direction inclined in the −Z direction from a position in the +Y direction to a position in the −Y direction. The tip of an arrow indicating direction A corresponds to direction +A, and the tail of the arrow indicating direction A corresponds to direction −A. Direction +A is an inclination direction in which a processing tray 42 described later extends. Direction +A is an example of a transport direction in which the sheet P on the processing tray 42 is transported by a transport section 50.

Direction B is orthogonal to direction A when viewed in the X direction. The tip of an arrow indicating direction B corresponds to direction +B, and the tail of the arrow indicating direction B corresponds to direction −B. Direction +B is an example of a stacking direction in which sheets P are stacked.

In the recording system 1, a recording unit 2, an intermediate unit 4, and the post-processing device 30 are provided in this order in the +Y direction. In the recording system 1, the recording unit 2, the intermediate unit 4, and the post-processing device 30 are mechanically and electrically coupled to each other. The intermediate unit 4 transports the sheet P, which is fed from the recording unit 2, to the post-processing device 30.

Note that the recording system 1 is configured such that the sheet P having information recorded thereon by an image forming section 10 described later is subjected to post-processing. The recording system 1 may include an operation section (not illustrated) operated by a user. The recording system 1 may receive recording information from an external computer.

In the recording system 1, a path on which the sheet P is transported from the recording unit 2 to the post-processing device 30 via the intermediate unit 4 is a transport path T. A transport mechanism section 9 (FIG. 2) is provided on the transport path T.

The transport mechanism section 9 is provided over the entire recording system 1. The transport mechanism section 9 includes a plurality of roller pairs and a plurality of motors, which are not illustrated, and transports the sheet P. Specifically, the transport mechanism section 9 transports the sheet P from a storage cassette 18 to a recording region of a recording section 20 and further transports the sheet P from the recording region to the post-processing device 30 via the intermediate unit 4.

The recording unit 2 records various kinds of information on the transported sheet P. The recording unit 2 includes, for example, the image forming section 10, a scanner section 12, a cassette accommodating section 14, and a transport mechanism (not illustrated).

The image forming section 10 includes the recording section 20 and a control section 24. The scanner section 12 reads information of a document (not illustrated). The cassette accommodating section 14 includes a plurality of storage cassettes 18 in which a plurality of sheets P are stored. The recording section 20 is constituted by, for example, a line head. The recording section 20 includes an ejecting section (not illustrated) constituted by a plurality of nozzles. The recording section 20 performs recording on the sheet P by ejecting the ink Q.

Figure 2:
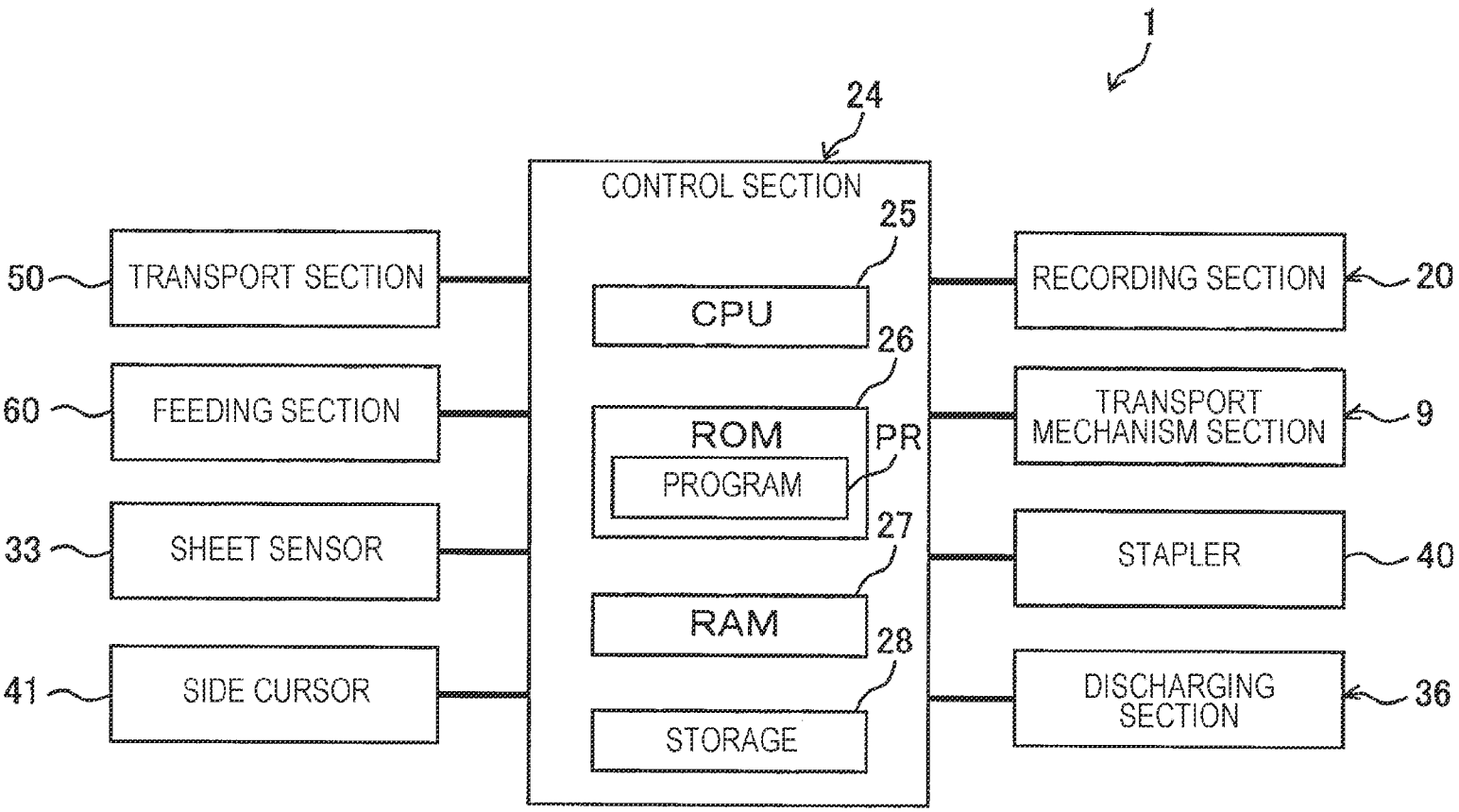
FIG. 2 is a block diagram of a portion of the recording system according to Embodiment 1.

As illustrated in FIG. 2, the control section 24, which functions as a computer, includes a central processing unit (CPU) 25, read-only memory (ROM) 26, random access memory (RAM) 27, and storage 28.

The control section 24 is able to control operations of the respective sections of the recording system 1. Specifically, the control section 24 controls operations of the recording section 20, the transport mechanism section 9, a stapler 40, a discharging section 36, the transport section 50, a feeding section 60, a sheet sensor 33, and a side cursor 41 in accordance with information input from an external device or information stored in the ROM 26 or the storage 28.

Various kinds of data including a program PR executed by the CPU 25 are stored in the ROM 26. In other words, the ROM 26 is an example of a computer-readable recording medium in which the program PR is stored. Other examples of the recording medium include a compact disc (CD), a digital versatile disc (DVD), a Blue-ray disc, and universal serial bus (USB) memory. Moreover, the program PR is able to be loaded into a portion of the RAM 27.

The program PR is a program for causing the CPU 25 to perform the respective operations in the post-processing device 30 (FIG. 1).

Figure 3:
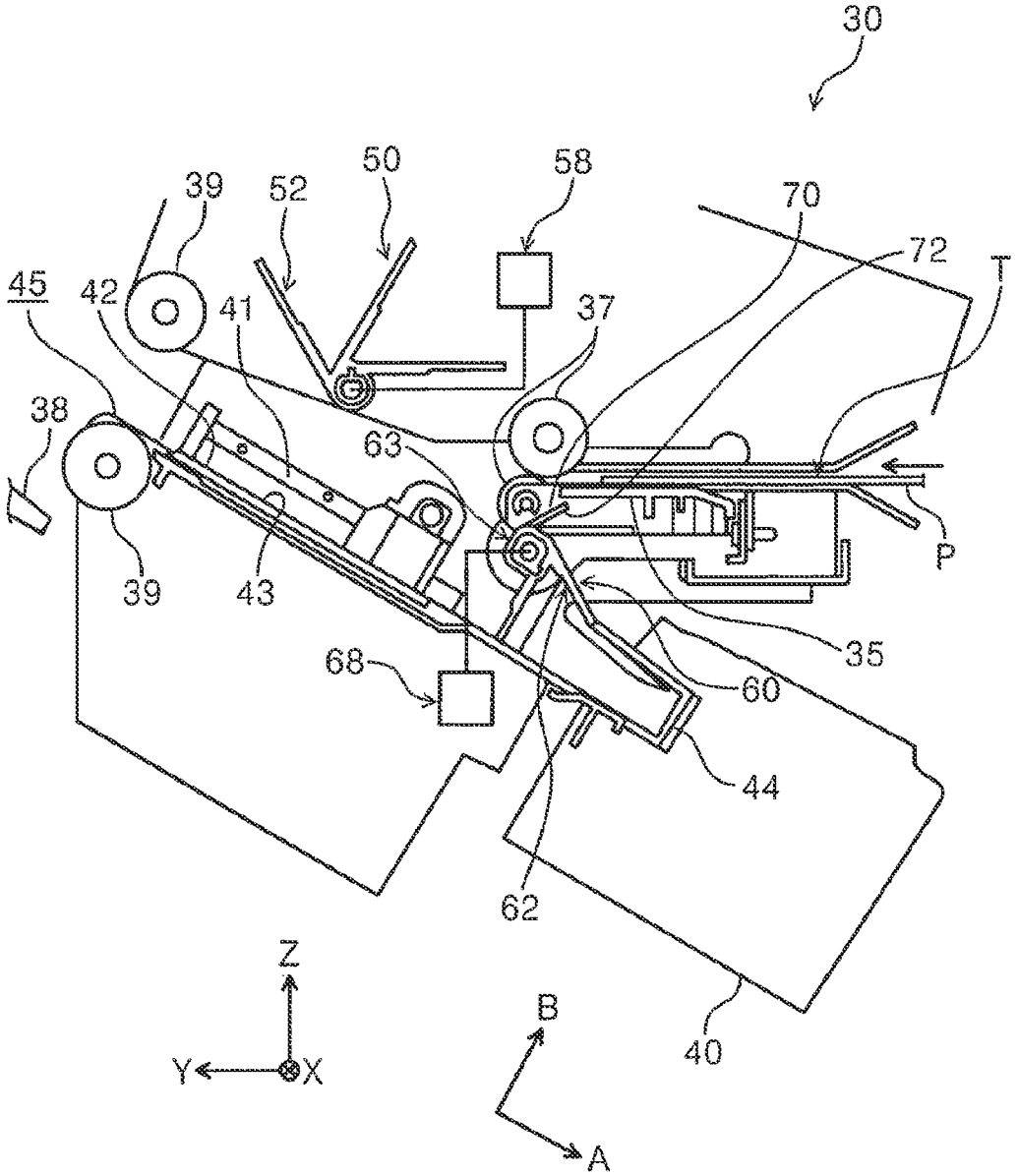
FIG. 3 illustrates a portion of a post-processing device according to Embodiment 1 in an enlarged manner.

As illustrated in FIGS. 1 to 3, the post-processing device 30 includes a housing 32, the sheet sensor 33, a lower plate 35, the side cursor 41, a discharge tray 38, and the stapler 40. The post-processing device 30 further includes the processing tray 42, an aligning plate 44, the transport section 50, the feeding section 60, a pressing section 70, and the control section 24. The control section 24 also functions as, for example, a control section of the post-processing device 30. The sheet P is transported from the recording section 20 to the post-processing device 30.

A portion of the transport path T is formed in the housing 32.

The sheet sensor 33 is provided on the transport path T. The sheet sensor 33 includes, for example, a light-emitting section and a light-receiving section, which are not illustrated. The sheet sensor 33 determines whether or not light from the light-emitting section is received by the light-receiving section and thereby detects a time point when the sheet P passes through the sheet sensor 33 and a position of the sheet P on the transport path T. The time point when the sheet P passes through the sheet sensor 33 and the position of the sheet P, which have been detected by the sheet sensor 33, are transmitted as information to the control section 24.

The lower plate 35 is located in the +Z direction with respect to the feeding section 60 described later. The lower plate 35 is constituted by a plate having a predetermined thickness in the Z direction and extending in the X direction. The lower plate 35 forms a bottom of a portion of the transport path T.

Figure 4:
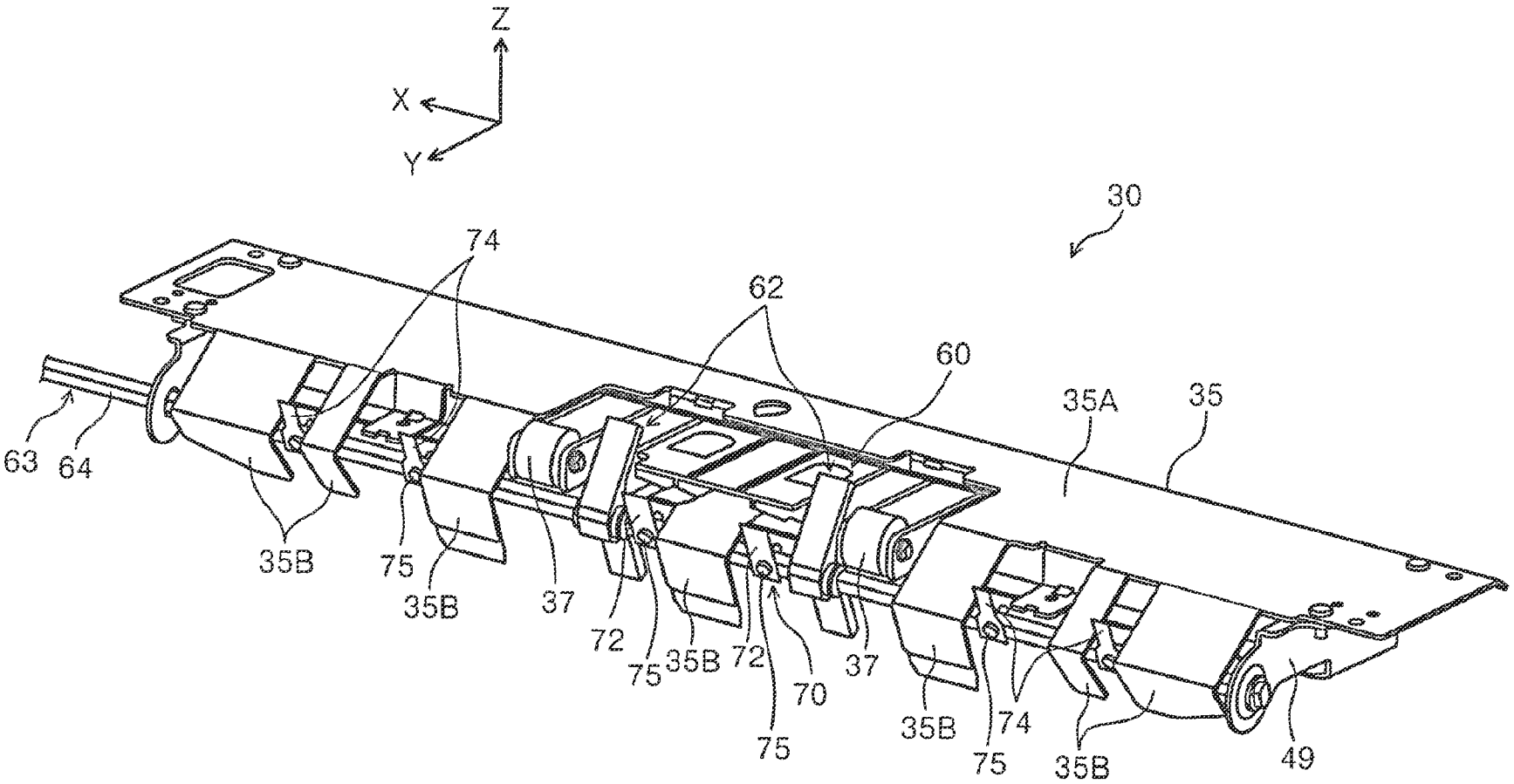
FIG. 4 is a perspective view of a portion of the post-processing device according to Embodiment 1.

As illustrated in FIG. 4, the lower plate 35 includes, for example, a planar plate section 35A and a bent section 35B.

The planar plate section 35A has a predetermined thickness in the Z direction and has a rectangular shape having a dimension in the X direction longer than a dimension in the Y direction.

The bent section 35B is a portion which is formed to be continuous at an end in the +Y direction of the planar plate section 35A and which is bent so as to protrude in the +Y direction. A plurality of bent sections 35B are formed with gaps therebetween in the X direction. The plurality of bent sections 35B have a function of preventing a shaft section 63 described later from coming into contact with the sheet P and a function of guiding the sheet P to the processing tray 42 (FIG. 1).

A support frame 49 is attached to the lower plate 35 in the −Z direction.

The stapler 40 illustrated in FIG. 3 is an example of a post-processing section. That is, in the present embodiment, stapling processing for binding a plurality of sheets P is performed as an example of post-processing performed by the post-processing device 30. Specifically, the stapler 40 binds a sheet bundle M (FIG. 1) by using a staple (not illustrated) at ends in the direction +A of the plurality of sheets P stacked on the processing tray 42 described later.

The side cursor 41 is provided on the processing tray 42 described later. Moreover, a pair of side cursors 41 are provided with a gap therebetween in the X direction. The side cursors 41 are driven in the X direction by a driving mechanism constituted by a motor, a pinion, and a rack, which are not illustrated. When the plurality of sheets P are stacked on the processing tray 42, the side cursors 41 move in the X direction to align ends of the plurality of sheets P on both sides in the X direction. Note that, for example, after the aligning plate 44 aligns the ends in the direction +A of the plurality of sheets P, the side cursors 41 align the ends on both sides in the X direction of the plurality of sheets P.

The discharge tray 38 is provided in the housing 32 (FIG. 1). The sheet bundle M bound by the stapler 40 is discharged to the discharge tray 38.

The processing tray 42 is an example of a mounting section on which the sheet P is able to be mounted before being subjected to stapling processing by the stapler 40. Specifically, the processing tray 42 includes a mounting surface 43 on which the sheet P is mounted. The mounting surface 43 extends in direction A and is inclined with respect to the Y direction.

Figure 5:
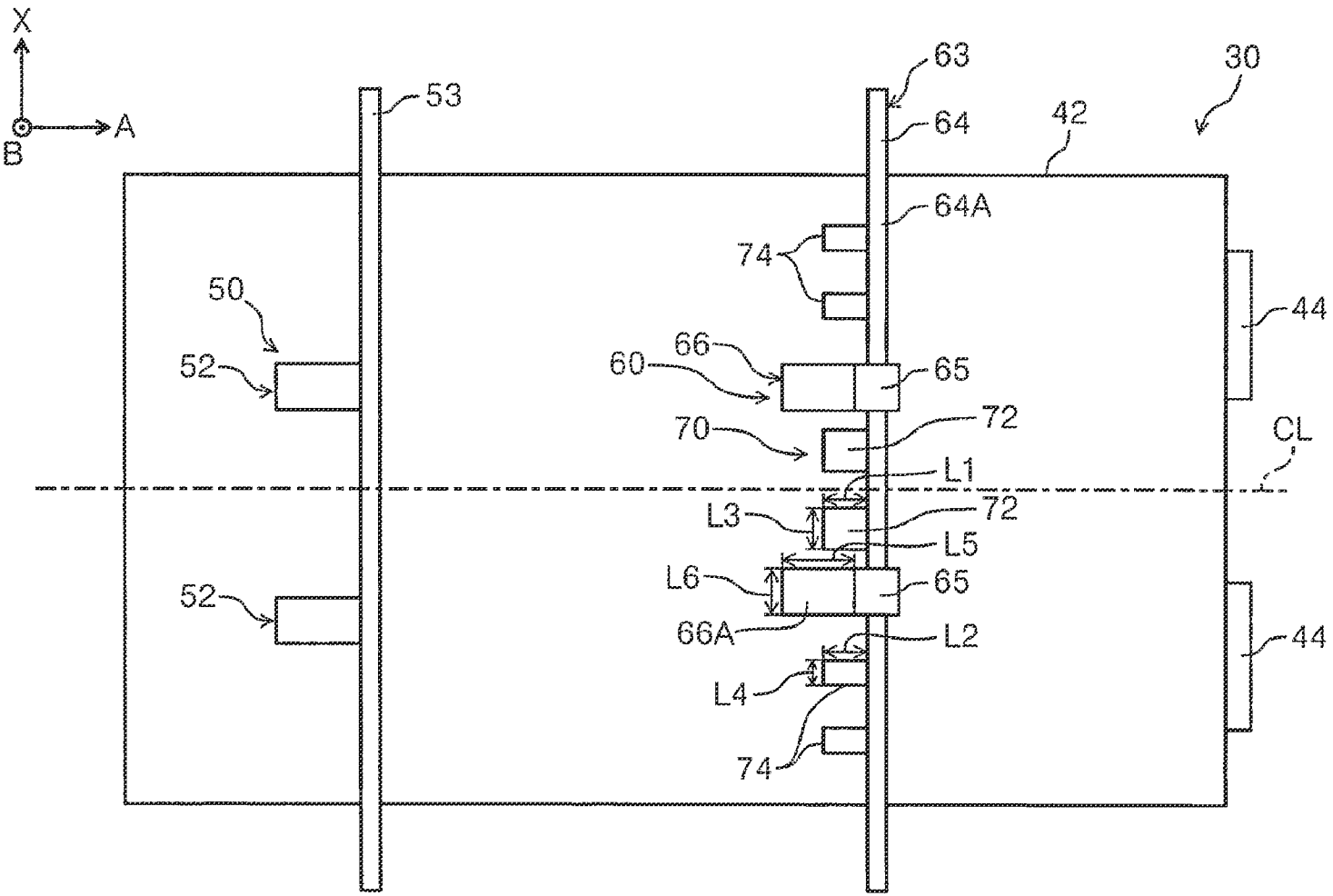
FIG. 5 is a plan view illustrating an arrangement relationship between a sheet and a transport paddle, a feeding paddle, and a pressing section, in the post-processing device according to Embodiment 1.

For example, the sheet P is mounted on the mounting surface 43 such that a dimension in the X direction is longer than a dimension in direction A. The dimension of the mounting surface 43 in the X direction is longer than the maximum dimension of the sheet P usable in the recording system 1. A line passing through the center of the processing tray 42 in the X direction and extending in direction A is a center line CL (FIG. 5).

An opening 45 is formed in the direction −A end of the processing tray 42. The processing tray 42 is coupled to the discharge tray 38 via the opening 45. Accordingly, the sheet P or the sheet bundle M mounted on the processing tray 42 is discharged to the discharge tray 38 through the opening 45 by the transport section 50 described later.

Figure 6:
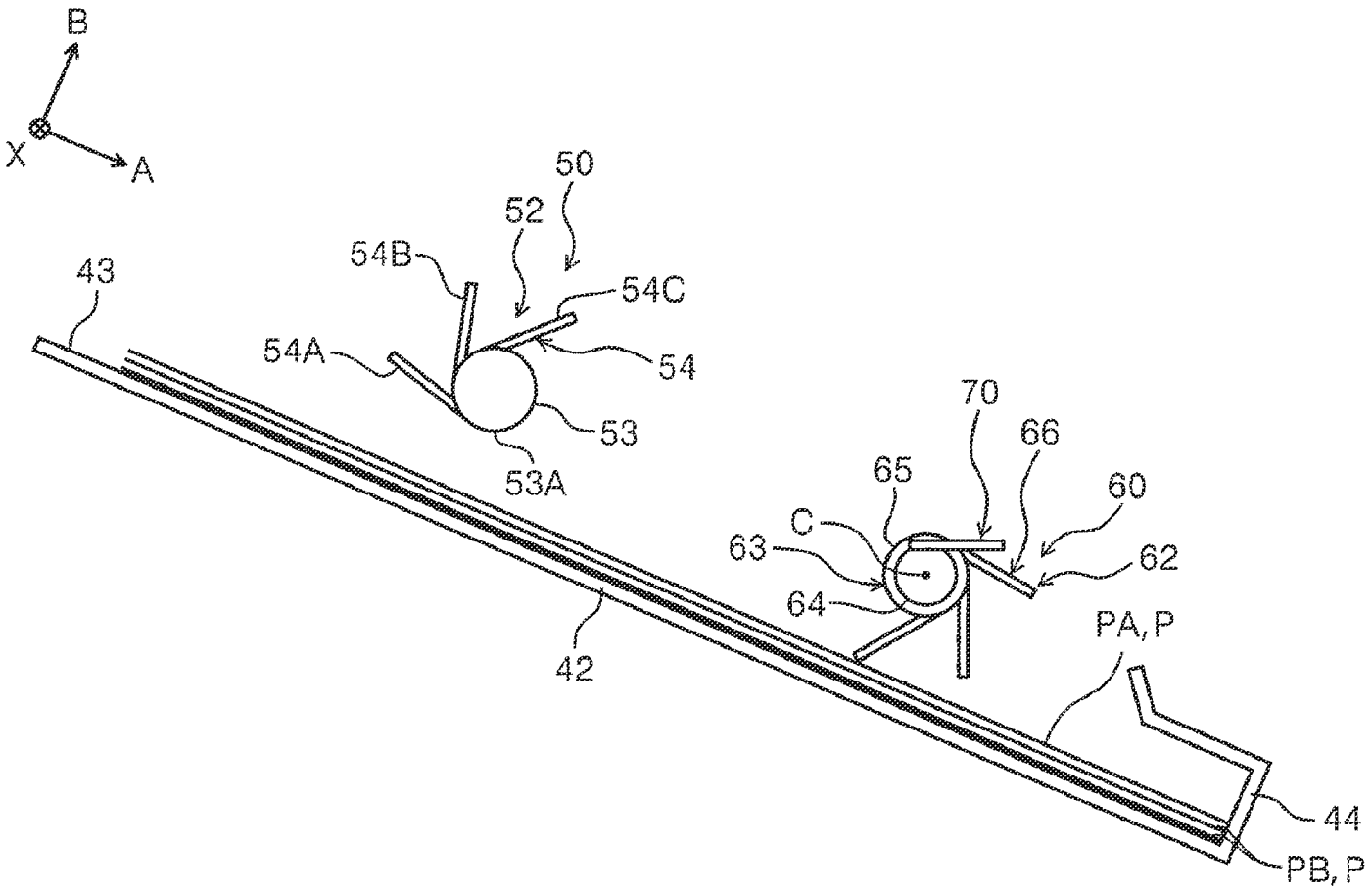
FIG. 6 illustrates a processing tray, the transport paddle, and the feeding paddle in the post-processing device according to Embodiment 1.

Here, one sheet P at the highest position in direction B, that is, the uppermost sheet P, of the plurality of sheets P mounted and stacked on the processing tray 42 is an upper sheet PA (FIG. 6), and at least one sheet P located in direction −B with respect to the upper sheet PA is a lower sheet PB (FIG. 6). The upper sheet PA is an example of an upper medium. Note that when it is not necessary to distinguish between the upper sheet PA and the lower sheet PB, a sheet is simply referred to as a sheet P.

The aligning plate 44 is an example of an aligning section that aligns ends of the plurality of sheets P stacked on the processing tray 42. The aligning plate 44 comes into contact with the ends in direction +A of the plurality of sheets P and thereby aligns the ends. An operation of the aligning plate 44 for aligning the plurality of sheets P aligns the sheets P such that the ends in direction A of the sheets P are linearly arranged in direction B. Specifically, the aligning plate 44 stands upright in direction B from the end in direction A of the processing tray 42. For example, two aligning plates 44 are provided with a gap therebetween in the X direction.

A pair of transport rollers 37 is provided at the end in the +Y direction of the lower plate 35. When rotated by a motor (not illustrated), the pair of transport rollers 37 transports the sheet P on the transport path T toward the processing tray 42.

A pair of discharge rollers 39 is provided at the end in the direction −A of the processing tray 42. When rotated by a motor (not illustrated), the pair of discharge rollers 39 discharges the sheet bundle M toward the discharge tray 38.

The transport section 50 includes, for example, a transport paddle 52, a transport motor 58 that drives the transport paddle 52, and a gear (not illustrated). Driving of the transport motor 58 is controlled by the control section 24 (FIG. 2).

The transport section 50 transports the sheet P on the processing tray 42 toward the aligning plate 44 in direction +A. Note that, when the transport section 50 transports the upper sheet PA (FIG. 6), the lower sheet PB (FIG. 6) has already been in contact with the aligning plate 44 and thus remains in place.

The transport paddle 52 is located in the +Z direction with respect to a portion of the processing tray 42, the portion being in direction −A with respect to the center of the processing tray 42 in direction A. Moreover, the transport paddle 52 is located in the +Z direction with respect to the sheet P transported toward the processing tray 42.

FIG. 6 schematically illustrates the respective members. The transport paddle 52 is provided so as to be rotatable with the axial direction being the X direction. The transport paddle 52 includes, for example, a column-shaped shaft section 53 and an extending section 54 provided in the shaft section 53. For example, four extending sections 54 are provided in the shaft section 53 with gaps therebetween in the X direction.

The extending section 54 is constituted by a plate section 54A, a plate section 54B, and a plate section 54C. The plate section 54A, the plate section 54B, and the plate section 54C have substantially the same dimensions.

Both ends of the shaft section 53 in the X direction are rotatably supported by a support frame (not illustrated).

The plate section 54A, the plate section 54B, and the plate section 54C are made of, for example, rubber and provided with gaps therebetween so as to form an angle of substantially 60° with respect to each other in a circumferential direction of the shaft section 53. The plate section 54A, the plate section 54B, and the plate section 54C extend in different directions tangential to an outer circumferential surface 53A of the shaft section 53. Note that the transport paddle 52 may be used to discharge the sheet bundle M from the processing tray 42 toward the discharge tray 38 (FIG. 1).

The transport section 50 is provided so as to be able to switch between a contact state in which the transport section 50 is in contact with the sheet P and a retreat state in which the transport section 50 is retreated from the sheet P.

The contact state of the transport section 50 is a state in which any one of the plate section 54A, the plate section 54B, and the plate section 54C is in contact with the sheet P.

The retreat state of the transport section 50 is a state in which none of the plate section 54A, the plate section 54B, and the plate section 54C are in contact with the sheet P.

The transport section 50 switches between the contact state and the retreat state upon rotation of the transport paddle 52.

As illustrated in FIG. 3, the feeding section 60 is provided between the transport section 50 and the aligning plate 44. The feeding section 60 feeds the sheet P in direction +A until the end in direction +A of the sheet P transported by the transport section 50 in direction +A comes into contact with the aligning plate 44. Further, the feeding section 60 performs a feeding operation for the sheet P in a state in which the pressing section 70 described later applies a pressing force to the sheet P.

The feeding section 60 includes, for example, a feeding paddle 62, a feeding motor 68 that drives the feeding paddle 62, and a gear (not illustrated). Driving of the feeding motor 68 is controlled by the control section 24 (FIG. 2). When the feeding paddle 62 rotates, the feeding section 60 feeds the sheet P toward the aligning plate 44.

Specifically, the feeding paddle 62 is located in the +Z direction with respect to a portion of the processing tray 42, the portion being in direction +A with respect to the center of the processing tray 42 in direction A. Moreover, the feeding paddle 62 is located in the −Z direction with respect to the pair of transport rollers 37. Further, the feeding paddle 62 is located in the +Z direction with respect to the sheet P transported toward the aligning plate 44.

As illustrated in FIG. 6, the feeding paddle 62 includes the shaft section 63 that extends in the X direction intersecting direction +A and an outer peripheral portion 66 that rotates about the shaft section 63. For example, two feeding paddles 62 are provided with a gap therebetween in the X direction (FIG. 4).

The shaft section 63 extends in the X direction intersecting direction +A. Both ends of the shaft section 63 in the X direction are rotatably supported by the support frame 49 (FIG. 4). The shaft section 63 includes, for example, a rotational shaft 64 and an enlarged diameter portion 65.

The feeding paddle 62 rotates about the rotational shaft 64.

Figure 8:
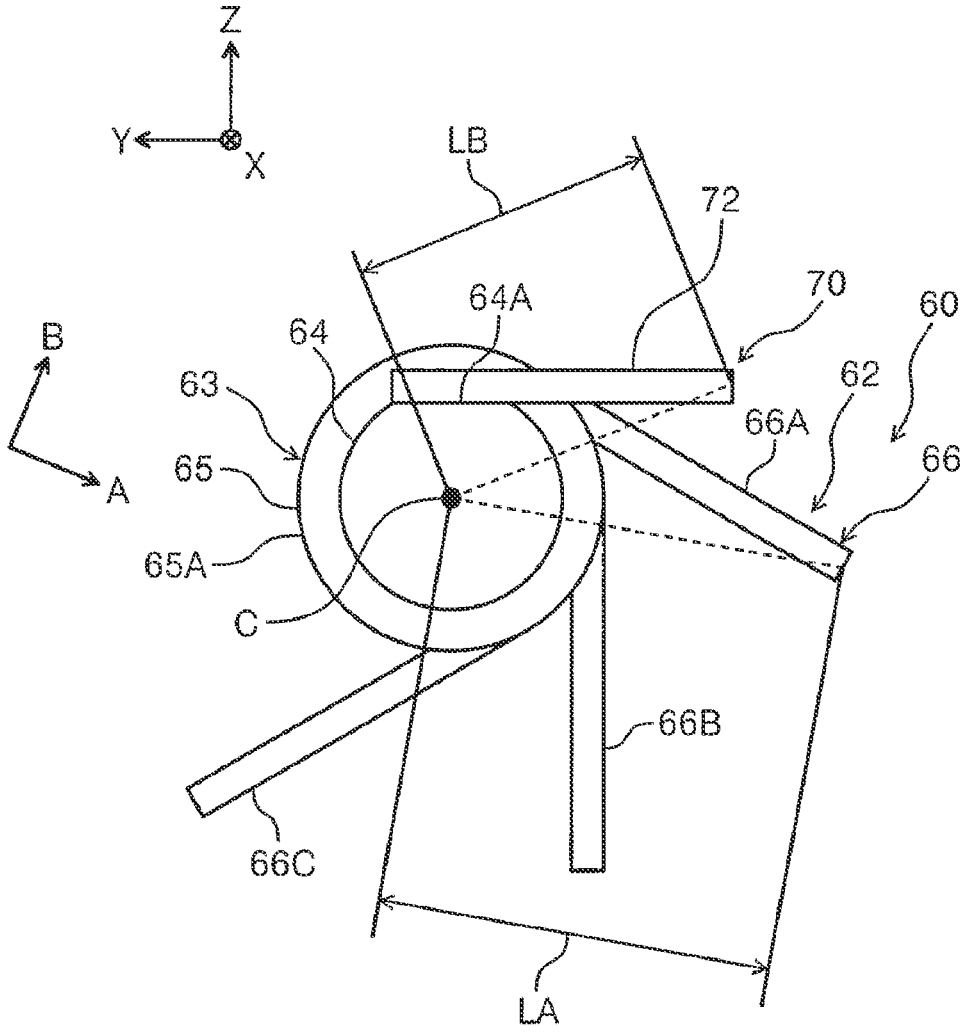
FIG. 8 is a side view illustrating an arrangement relationship between the rotational center of the feeding paddle and blade sections in the post-processing device according to Embodiment 1.

As illustrated in FIG. 8, the rotational shaft 64 has, for example, a column shape having a D-cut portion when viewed in the X direction. The rotational shaft 64 extends in the X direction. The rotational shaft 64 includes an outer peripheral surface 64A to which the pressing section 70 described later is attached.

The enlarged diameter portion 65 is a column-shaped portion formed by a portion of the rotational shaft 64 in the X direction which is enlarged in a radial direction. The enlarged diameter portion 65 has an outer circumferential surface 65A.

The rotational shaft 64 and the enlarged diameter portion 65 are located on the same shaft and have a common rotational center C.

The outer peripheral portion 66 is provided in, for example, only the enlarged diameter portion 65. The outer peripheral portion 66 is made of, for example, rubber and is elastically deformable in a rotational direction of the shaft section 63. The outer peripheral portion 66 includes a blade 66A, a blade 66B, and a blade 66C that extend outward from the outer circumferential surface 65A.

The blade 66A, the blade 66B, and the blade 66C are examples of a first blade section and are provided with gaps therebetween so as to form an angle of substantially 60° with respect to each other in a circumferential direction of the enlarged diameter portion 65. The blade 66A, the blade 66B, and the blade 66C extend from the outer circumferential surface 65A in different directions tangential to the outer circumferential surface 65A. In other words, the blade 66A, the blade 66B, and the blade 66C extend from the outer peripheral surface 64A when viewed in the X direction. Moreover, the blade 66A, the blade 66B, and the blade 66C have substantially the same dimensions in the extending direction and the X direction.

As illustrated in FIG. 3, the pressing section 70 is provided between the transport section 50 and the aligning plate 44 in direction A and is configured to apply a pressing force having a component in direction −A opposite from direction +A to the sheet P. The pressing section 70 applies the pressing force to the sheet P before the feeding section 60 applies a feeding force to the sheet P. The pressing section 70 applies the pressing force to the sheet P when the transport section 50 is in the retreat state described above.

Herein, "before the feeding section 60 applies a feeding force to the sheet P" may denote a time-based relation during a single-rotation operation in which the feeding section 60 completes a single rotation. That is, the configuration may be such that the pressing section 70 applies the pressing force to the sheet P before the feeding section 60 applies the feeding force during the single-rotation operation in which the feeding section 60 completes a single rotation.

The pressing section 70 applies the pressing force to a portion of the upper sheet PA (FIG. 6) at a position below the rotational center C (FIG. 6) of the shaft section 63 in direction B.

As illustrated in FIG. 5, the pressing section 70 includes, for example, two first pressing sheets 72 and four second pressing sheets 74. The pressing section 70 rotates about the rotational shaft 64 in the same rotational direction as the feeding section 60.

The two first pressing sheets 72 and the four second pressing sheets 74 are examples of a second blade section and extend from the outer peripheral surface 64A of the rotational shaft 64. The two first pressing sheets 72 and the four second pressing sheets 74 are formed, for example, by cutting a polyester film. That is, the two first pressing sheets 72 and the four second pressing sheets 74 are each formed of an elastically deformable member. The two first pressing sheets 72 and the four second pressing sheets 74 are each attached to the outer peripheral surface 64A by using a screw 75 (FIG. 4).

A first pressing sheet 72 is provided at a position preceding the feeding paddle 62 in direction +R, which is the rotational direction of the feeding paddle 62. In other words, the first pressing sheet 72 applies the pressing force to the sheet P before the feeding paddle 62 applies the feeding force to the sheet P. Herein, "preceding the feeding paddle 62 in the rotational direction" denotes that the feeding paddle 62 is preceded only during a single-rotation operation in which the feeding paddle 62 of the feeding section 60 completes a single rotation.

The two first pressing sheets 72 are located closer than the two feeding paddles 62 to the center of the processing tray 42 in the X direction. Moreover, the two first pressing sheets 72 are located to be linearly symmetrical about the center line CL.

The four second pressing sheets 74 are provided such that two second pressing sheets 74 are used as a pair; in other words, a pair of second pressing sheets 74 is provided in the +X direction with respect to the feeding paddle 62 provided in the +X direction, and a pair of second pressing sheets 74 is provided in the −X direction with respect to the feeding paddle 62 provided in the −X direction. The two pairs of second pressing sheets 74 are located to be linearly symmetrical about the center line CL.

When the pressing section 70 is viewed from top to bottom in direction B, dimension L1 [mm] of a first pressing sheet 72 in direction A is, for example, substantially the same as dimension L2 [mm] of a second pressing sheet 74 in direction A. Dimension L3 [mm] corresponding to the width of the first pressing sheet 72 in the X direction is, for example, larger than dimension L4 [mm] corresponding to the width of the second pressing sheet 74 in the X direction. Dimension L1 is, for example, substantially half the dimension L5 [mm] of the blade 66A in direction A. For example, dimension L3 is smaller than dimension L6 [mm] corresponding to the width of the blade 66A in the X direction.

Note that neither the blade 66B nor the blade 66C is illustrated in FIG. 5.

Figure 7:
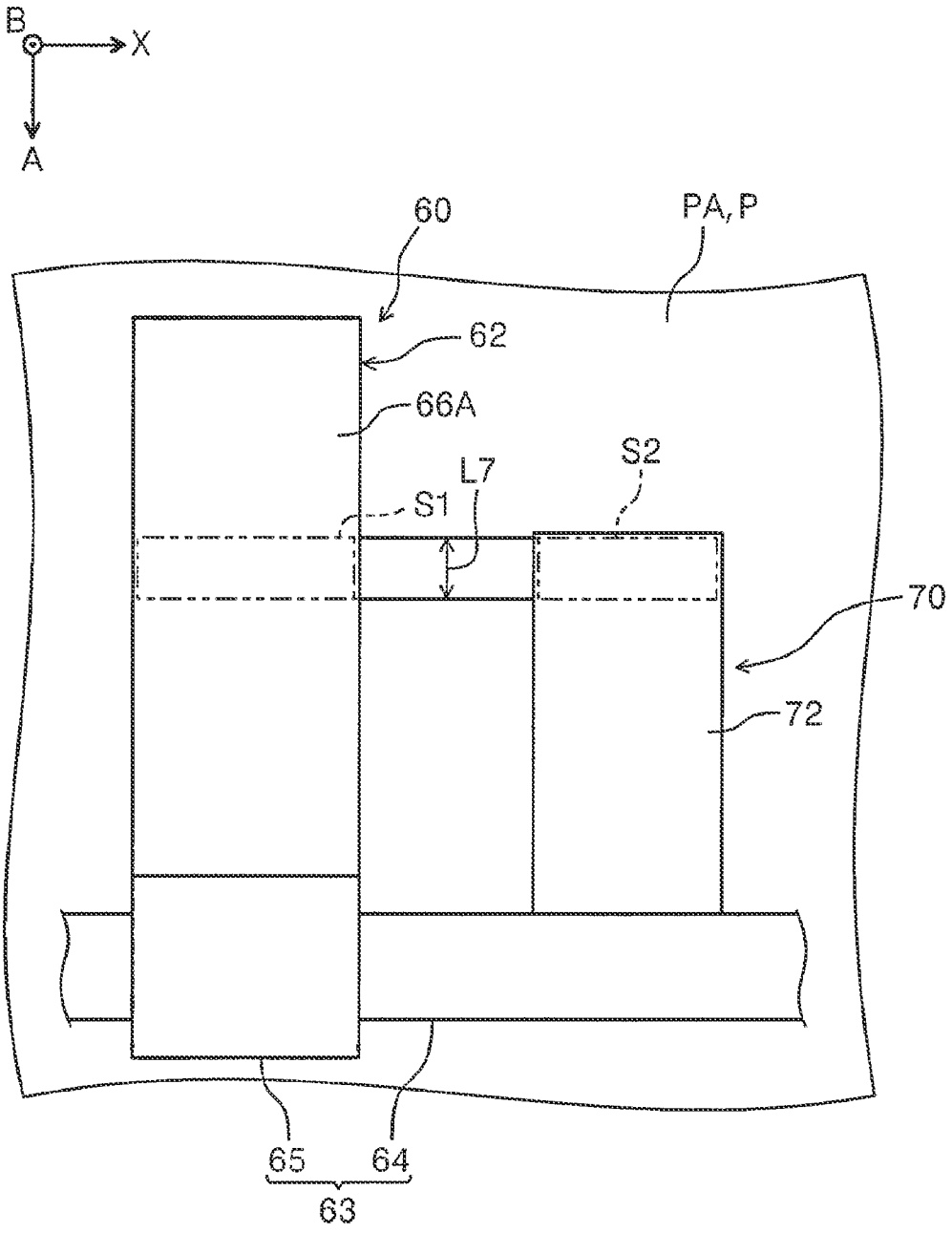
FIG. 7 is a plan view illustrating a state of a partial portion in which the feeding paddle and a pressing sheet come into contact with the sheet in the post-processing device according to Embodiment 1.

As illustrated in FIG. 7, when viewed from top to bottom in direction B, a second region S2 of the sheet P, in which the pressing force of the first pressing sheet 72 acts, and a first region S1 of the sheet P, in which the feeding force of the blade 66A acts, are arranged side by side in the X direction. In other words, the blade 66A and the first pressing sheet 72 are located such that the first region S1 and the second region S2 overlap each other in a range of dimension L7 [mm] in direction A. Note that the first region S1 and the second region S2 may be formed at the same position or different positions in direction A.

Although a region of the sheet P, in which the pressing force of the second pressing sheet 74 (FIG. 5) acts, is, for example, at substantially the same position as the second region S2 in the Y direction, a position at which the second region S2 is formed may be shifted in direction A between the first pressing sheet 72 and the second pressing sheet 74.

A second frictional coefficient μ2 at a position at which the first pressing sheet 72 of the pressing section 70 is in contact with the sheet P is lower than a first frictional coefficient μ1 at a position at which the blade 66A of the feeding section 60 is in contact with the sheet P. In other words, a frictional force generated in the second region S2 is less than a frictional force generated in the first region S1. Neither the first frictional coefficient μ1 nor the second frictional coefficient μ2 is illustrated in the drawings.

A second elastic modulus E2 of the first pressing sheet 72 and the second pressing sheet 74 of the pressing section 70 is lower than a first elastic modulus E1 of the feeding section 60. Neither the first elastic modulus E1 nor the second elastic modulus E2 is illustrated in the drawings. Note that an elastic modulus corresponds to a value represented by F/L as a deflection amount L [m] of a member when a certain stress F [N] is applied. That is, a lower elastic modulus readily causes deflection. Examples of the elastic modulus include a tensile modulus, a shear modulus, a bulk modulus, and a rigidity modulus. A tensile modulus is also referred to as Young's modulus.

As illustrated in FIG. 8, when viewed in the X direction, a second distance LB [mm] from the rotational center C of the rotational shaft 64 to a tip end of the first pressing sheet 72 is less than a first distance LA [mm] from the rotational center C to a tip end of the blade 66A.

Note that the feeding paddle 62 is configured such that, when the feeding paddle 62 starts to rotate, the feeding paddle 62 stops rotating at a stop position set in advance such that the first pressing sheet 72 and the second pressing sheet 74 (FIG. 5) come into contact with the sheet P before the blade 66A, the blade 66B, and the blade 66C come into contact with the sheet P.

Figure 11:
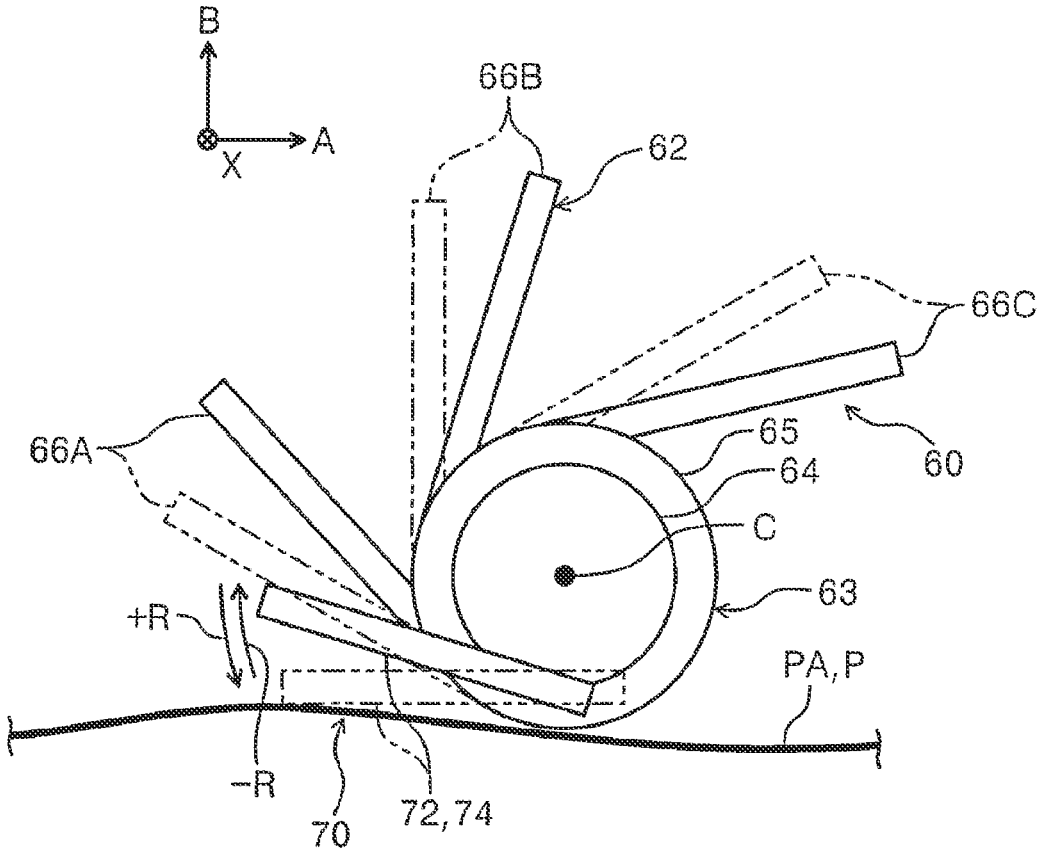
FIG. 11 illustrates a state in which the feeding paddle rotates in reverse after the pressing section presses the sheet in the post-processing device according to Embodiment 1.

As illustrated in FIG. 11, in the rotational direction of the feeding paddle 62, when viewed in the +X direction, for example, a counterclockwise direction is a first direction, and a clockwise direction is a second direction. In the following description, the first direction is referred to as direction +R represented by arrow +R, and the second direction is referred to as direction −R represented by arrow −R.

Here, the first pressing sheet 72 and the second pressing sheet 74 of the pressing section 70 perform a pressing operation of applying the pressing force to the sheet P by being rotated in direction +R when viewed in the X direction. Moreover, the configuration is such that the first pressing sheet 72 and the second pressing sheet 74 retreat from the sheet P by being rotated in direction −R opposite from direction +R after the pressing operation and before the blade 66A of the feeding section 60 applies the feeding force to the sheet P.

Next, operations of the recording system 1 and the post-processing device 30 of Embodiment 1 will be described. Note that components of the recording system 1 and the post-processing device 30, which have been described, will be described with reference to reference numerals in FIGS. 1 to 8, and references to individual drawings will be omitted.

Figure 9:
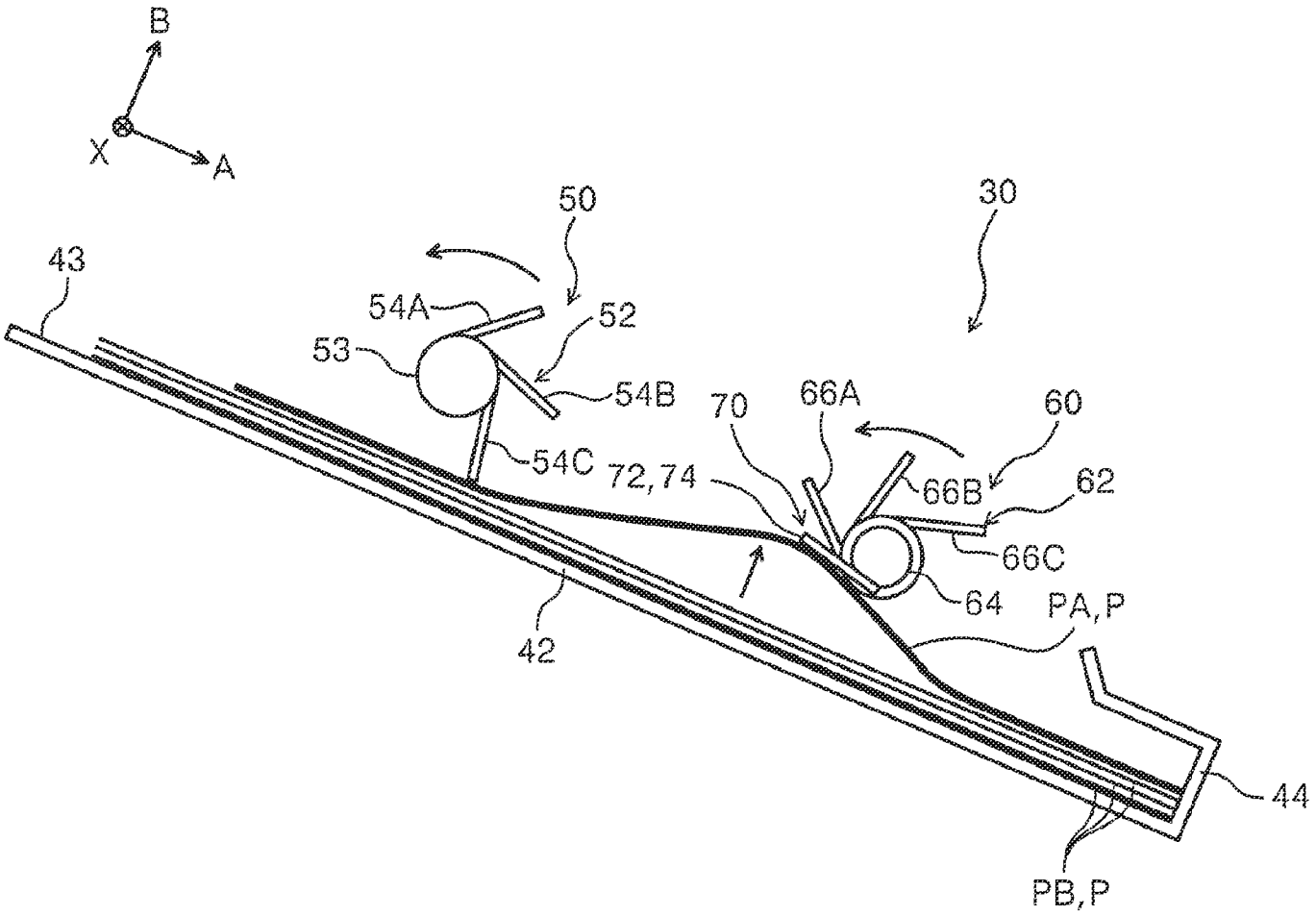
FIG. 9 illustrates a state in which a bulge of the sheet is pressed on the processing tray in the post-processing device according to Embodiment 1.

As illustrated in FIG. 9, in a state in which a plurality of lower sheets PB are stacked on the processing tray 42, the transported upper sheet PA is mounted on the uppermost lower sheet PB. The upper sheet PA starts to move toward the aligning plate 44 by receiving a transporting force from the transport paddle 52 that rotates. When the upper sheet PA further receives a transporting force from the feeding paddle 62, a leading end of the upper sheet PA in direction +A comes into contact with the aligning plate 44. When the upper sheet PA further receives a transporting force from the transport paddle 52, a portion of the upper sheet PA may bulge in direction +B.

Note that, also after the leading end of the upper sheet PA in direction +A theoretically comes into contact with the aligning plate 44, the control section 24 causes the transport paddle 52 and the feeding paddle 62 to rotate by a predetermined amount. Such rotation is performed to enable the leading end of the upper sheet PA in direction +A to reliably come into contact with the aligning plate 44. At this time, when the upper sheet PA has low stiffness, a portion of the upper sheet PA bulges in direction +B as described above.

The upper sheet PA readily bulges in a state in which the transport paddle 52 applies the transporting force to the upper sheet PA and in which the feeding paddle 62 is away from the upper sheet PA.

When one of the transport paddle 52 and the feeding paddle 62 is in contact with the upper sheet PA, the other is not in contact with the upper sheet PA in some cases. That is, a state in which only the transport paddle 52 comes into contact with the upper sheet PA to apply the transporting force and in which the feeding paddle 62 is away from the upper sheet PA may occur. In this state, when the leading end of the upper sheet PA in direction +A is in contact with the aligning plate 44, the upper sheet PA may be deflected upward and form a bulge. The bulge of the upper sheet PA is not limited to being formed in such a manner.

As illustrated in FIG. 9, a top of the bulge of the upper sheet PA is readily formed between the transport paddle 52 and the feeding paddle 62. When such a bulge remains, the bulge may be fed to a portion in the direction +A passing the feeding paddle 62 due to rotation of the feeding paddle 62, that is, an excessive transporting force of the feeding section 60. More specifically, when the bulge remains and the feeding paddle 62 rotates, an area in which the feeding paddle 62 comes into contact with the upper sheet PA increases, and an excessive transporting force may be applied to the upper sheet PA by the feeding section 60.

When an excessive transporting force is applied to the upper sheet PA, the bulge may become larger. In this instance, the sheets P may be aligned on the processing tray 42 where alignment of the sheets P deteriorates. Note that the aforementioned rotation of the transport paddle 52 and the feeding paddle 62 by a predetermined amount, that is, rotation of the transport paddle 52 and the feeding paddle 62 by a predetermined amount after the leading end of the upper sheet PA in direction +A theoretically comes into contact with the aligning plate 44, is controlled by the control section 24 such that the bulge formed in the upper sheet PA does not exceed the rotational center C (FIG. 8) of the rotational shaft 64 in direction +B.

Figure 10:
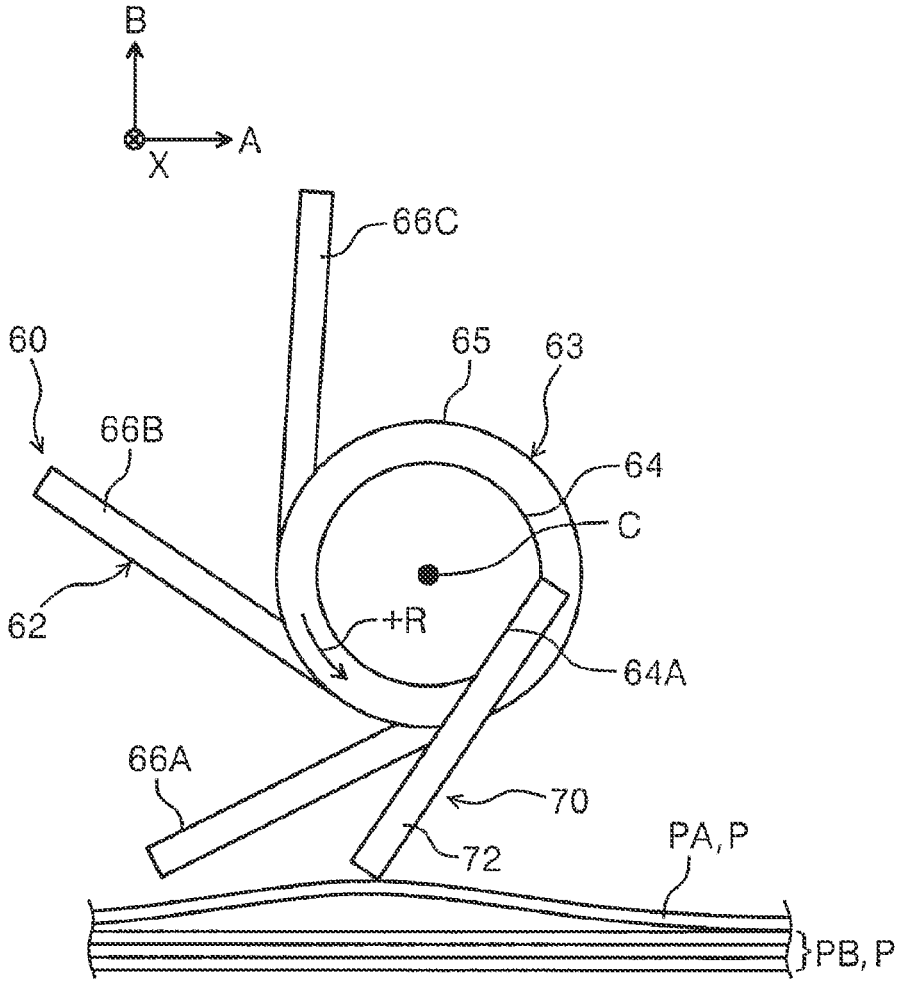
FIG. 10 illustrates a state in which the pressing section and the feeding paddle come into contact with the sheet in the post-processing device according to Embodiment 1.

In view of the foregoing problem, the post-processing device 30 has the following feature. Specifically, as illustrated in FIG. 10, the feeding paddle 62 rotates in direction +R. The first pressing sheet 72 and the second pressing sheet 74 (FIG. 5) come into contact with the bulged portion of the upper sheet PA before the blade 66A, the blade 66B, and the blade 66C come into contact with the upper sheet PA. A pressing force having a component in direction −A is thereby applied to the upper sheet PA by the first pressing sheet 72 and the second pressing sheet 74. At this time, due to rotation of the transport paddle 52, the plate section 54A, the plate section 54B, and the plate section 54C (FIG. 9) are in the retreat state of not being in contact with the upper sheet PA. Thus, a portion of the upper sheet PA, to which the pressing force is applied, moves in direction −A. As a result, the bulge of the upper sheet PA is reduced or eliminated.

Figure 12:
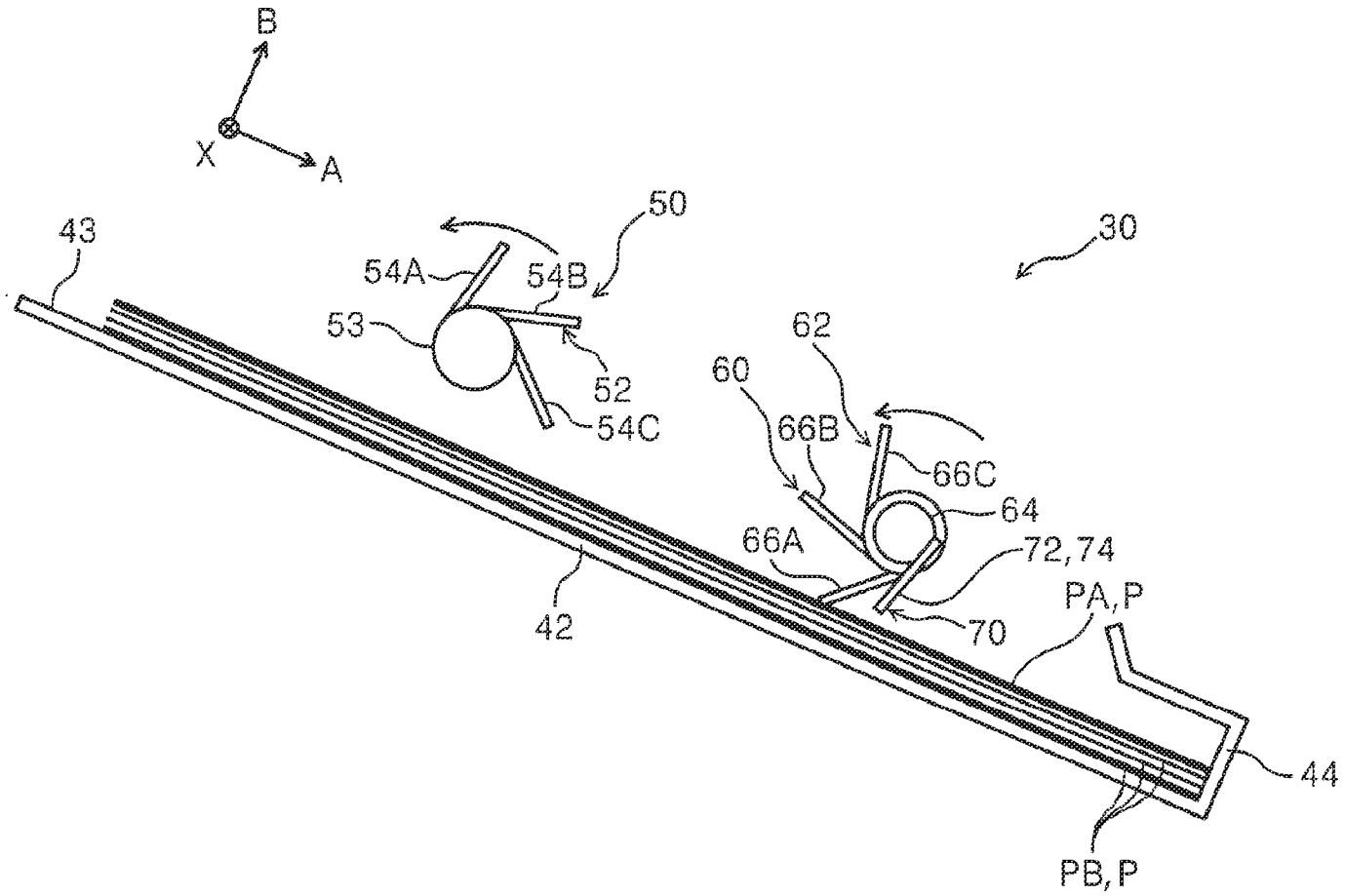
FIG. 12 illustrates a state in which the feeding paddle feeds the sheet toward the aligning section in the post-processing device according to Embodiment 1.

As illustrated in FIG. 12, in a state in which the bulge of the upper sheet PA is reduced or eliminated, the feeding paddle 62 continues to rotate in direction +R. The first pressing sheet 72 and the second pressing sheet 74 thereby separate from the upper sheet PA. When the blade 66A, the blade 66B, and the blade 66C come into contact with the upper sheet PA in this order, the upper sheet PA is fed toward the aligning plate 44. The end in direction A of the upper sheet PA is aligned with the end in direction A of the lower sheet PB by coming into contact with the aligning plate 44.

Note that, after the bulge of the upper sheet PA is eliminated, the upper sheet PA may be transported by using not the feeding paddle 62 but the transport paddle 52.

That is, as illustrated in FIG. 11, at a timing when the bulge of the upper sheet PA is substantially eliminated, the feeding paddle 62 rotates in direction −R, and the first pressing sheet 72 and the second pressing sheet 74 thereby separate from the upper sheet PA. In this state, the transport paddle 52 (FIG. 9) rotates in direction +R and comes into contact with the upper sheet PA. The upper sheet PA is thereby transported toward the aligning plate 44.

As described above, according to the post-processing device 30, the transport section 50 transports the sheet P on the processing tray 42 toward the aligning plate 44. A downstream end of the sheet P in direction +A, which is transported in direction +A by the transport section 50, reaches the aligning plate 44. At this time, when the transport section 50 applies the transporting force to the sheet P, a portion of the sheet P may be in a state of bulging in direction +B away from the processing tray 42.

Here, the pressing section 70 applies the pressing force to the sheet P before the feeding section 60 applies the feeding force to the sheet P. In other words, the pressing section 70 presses the bulge before the feeding section 60 presses the bulge. When the sheet P receives from the pressing section 70 the pressing force having the component in direction −A opposite from direction +A, the bulge is reduced or eliminated. The sheet P the bulge of which is reduced or eliminated is fed in direction +A by the feeding section 60. A downstream end of the sheet P in direction +A is then aligned by the aligning plate 44.

In this manner, when the bulge of the sheet P is suppressed, an area in which the feeding section 60 comes into contact with the sheet P is able to be reduced, and it is thus possible to suppress an excessive transporting force being applied from the feeding section 60 to the sheet P.

The upper sheet PA is located above the processing tray 42 and below the rotational shaft 64 in direction B.

Here, according to the post-processing device 30, the pressing section 70 applies the pressing force to a portion of the upper sheet PA, which is located below the rotational shaft 64 in direction B. As a result, it is possible to suppress the bulge of the upper sheet PA before an increase in the bulge compared with a configuration in which the pressing force is applied to a portion of the upper sheet PA, which is located above the rotational shaft 64.

According to the post-processing device 30, the position at which the pressing section 70 is in contact with the sheet P and the position at which the feeding section 60 is in contact with the sheet P are substantially the same in direction +A. Thus, since the feeding section 60 comes into contact with the sheet P in a short time after a bulge of the sheet P is reduced by being pressed by the pressing section 70, it is possible to suppress the sheet P, which has been pressed by the pressing section 70, largely bulging again.

According to the post-processing device 30, when the second distance LB is less than the first distance LA, the feeding force applied to the sheet P by the pressing section 70 is able to be less than the feeding force applied to the sheet P by the feeding section 60, and it is thus possible to suppress a load more than necessary being applied from the pressing section 70 to the sheet P. Note that, in the following description, forces applied to the sheet P by the pressing section 70 are distinguished such that a force having a component in direction −A is the pressing force and a force having a component in direction +A is the feeding force.

According to the post-processing device 30, the pressing section 70 rotates in direction +R and applies the pressing force to the sheet P to thereby suppress an increase in the bulge of the sheet P. In a state in which an increase in the bulge of the sheet P is suppressed, the pressing section 70 rotates in direction −R and thereby retreats from the sheet P. Accordingly, the feeding force applied to the sheet P by the pressing section 70 to be unnecessarily added to the transporting force for the sheet P is suppressed compared with a configuration in which the pressing section 70 continues to rotate in direction +R, thus making it possible to suppress an excessive increase in the transporting force applied to the sheet P by the feeding section 60.

According to the post-processing device 30, when the second frictional coefficient μ2 is lower than the first frictional coefficient μ1, the feeding force applied to the sheet P by the pressing section 70 is less than the feeding force applied to the sheet P by the feeding section 60. As a result, it is possible to suppress an unnecessary load being applied to the sheet P when the feeding section 60 feeds the sheet P.

According to the post-processing device 30, when the second elastic modulus E2 is lower than the first elastic modulus E1, the feeding force applied to the sheet P by the pressing section 70 is less than the feeding force applied to the sheet P by the feeding section 60. As a result, it is possible to suppress an unnecessary load being applied to the sheet P when the feeding section 60 feeds the sheet P.

According to the post-processing device 30, since the feeding section 60 performs the feeding operation for the sheet P in a state in which the pressing section 70 suppresses the bulge of the sheet P, it is possible to suppress an excessive transporting force being applied to the sheet P compared with a configuration in which the feeding section 60 performs the feeding operation for the sheet P after the pressing section 70 separates from the sheet P.

When the transport section 50 continuously applies the transporting force to the sheet P, the bulge of the sheet P may become large.

Here, according to the post-processing device 30, when the pressing section 70 applies the pressing force to the sheet P in the retreat state of the transport section 50 being retreated from the sheet P, it is possible to apply the pressing force to the sheet P while suppressing the bulge of the sheet P. As a result, it is possible to reduce the pressing force required to suppress the bulge of the sheet P compared with a configuration in which the pressing force is applied to the sheet P in a state in which the transport section 50 applies the transporting force to the sheet P.

According to the post-processing device 30, the transport section 50 transports the sheet P on the processing tray 42 toward the aligning plate 44. A downstream end in direction +A of the sheet P, which is transported in direction +A by the transport section 50, reaches the aligning plate 44. At this time, when the transport section 50 applies the transporting force to the sheet P, a portion of the sheet P may be in a state of bulging in direction +B away from the processing tray 42.

Here, the pressing section 70 rotates about the rotational shaft 64 serving as a rotational shaft of the feeding section 60. The pressing section 70 is provided at a position preceding the feeding section 60 in direction +R, which is the rotational direction of the feeding section 60.

Further, the pressing section 70 applies the pressing force having the component in direction −A opposite from direction +A to the sheet P.

Thus, the bulge of the sheet P is reduced or eliminated. The sheet P the bulge of which is reduced or eliminated is fed in direction +A by the feeding section 60. A downstream end of the sheet P in direction +A is then aligned by the aligning plate 44.

In this manner, when the bulge of the sheet P is suppressed, an area in which the feeding section 60 comes into contact with the sheet P is able to be reduced, thus making it possible to suppress an excessive transporting force being applied from the feeding section 60 to the sheet P.

Embodiment 2

Next, a post-processing device 80 of Embodiment 2 will be described with reference to the accompanying drawings. Note that the same parts as those of the post-processing device 30 of Embodiment 1 will be given the same reference numerals, and description thereof will be omitted.

Figure 13:
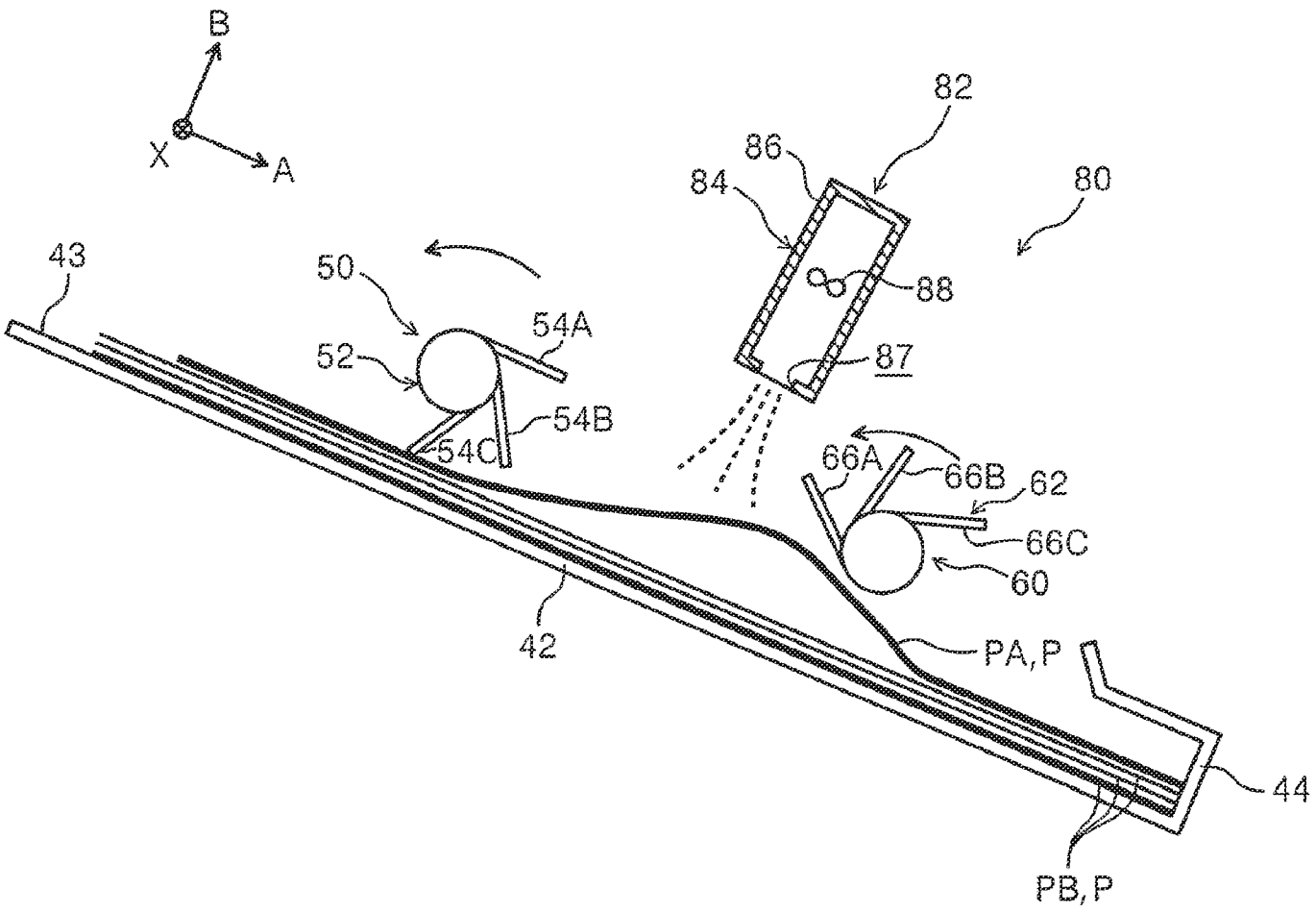
FIG. 13 illustrates a state in which a bulge of the sheet is pressed on the processing tray in a post-processing device according to Embodiment 2.

As illustrated in FIG. 13, the post-processing device 80 of Embodiment 2 is configured such that a pressing section 82 is provided instead of the pressing section 70 (FIG. 3) in the post-processing device 30 (FIG. 3) of Embodiment 1. Components other than the pressing section 82 are similar to those of Embodiment 1.

The pressing section 82 is provided between the transport section 50 and the aligning plate 44 and applies the pressing force having the component in direction −A opposite from direction +A to the sheet P. The pressing section 82 applies the pressing force to the sheet P before the feeding section 60 applies the feeding force to the sheet P. Specifically, the pressing section 82 is constituted by a blower unit 84.

The blower unit 84 is located in the +Z direction with respect to the sheet P. Moreover, the blower unit 84 is located downstream of the transport paddle 52 in direction +A and upstream of the feeding paddle 62 in direction +A. A distance between the blower unit 84 and the feeding paddle 62 in direction A is less than a distance between the blower unit 84 and the transport paddle 52 in direction A.

Specifically, the blower unit 84 includes a duct 86, a fan 88, and a motor (not illustrated) that rotates the fan 88.

The duct 86 has a hollow rectangular parallelepiped shape extending in the X direction. The dimension of the duct 86 in the X direction is longer than the dimension of the sheet P in the X direction. The duct 86 is arranged in direction B when viewed in the X direction. An opening 87 is formed in the direction −B end of the duct 86. The opening 87 is open in direction −B toward the sheet P and the processing tray 42. The number of openings 87 may be one or more.

In the duct 86, an airflow generated upon rotation of the fan 88 is blown onto the sheet P through the opening 87. In this manner, the blower unit 84 is configured to blow an airflow onto the sheet P to thereby eliminate a bulge of the sheet P.

Next, operation of the post-processing device 80 of Embodiment 2 will be described.

The upper sheet PA starts to move toward the aligning plate 44 by receiving the transporting force from the transport paddle 52. At this time, when the upper sheet PA further receives the transporting force in a state in which the end in direction A of the upper sheet PA is in contact with the aligning plate 44, a portion of the upper sheet PA may bulge in direction +B. Here, when the blower unit 84 blows air onto a bulged portion of the upper sheet PA, the bulge of the upper sheet PA is reduced or eliminated by receiving the pressing force.

Figure 14:
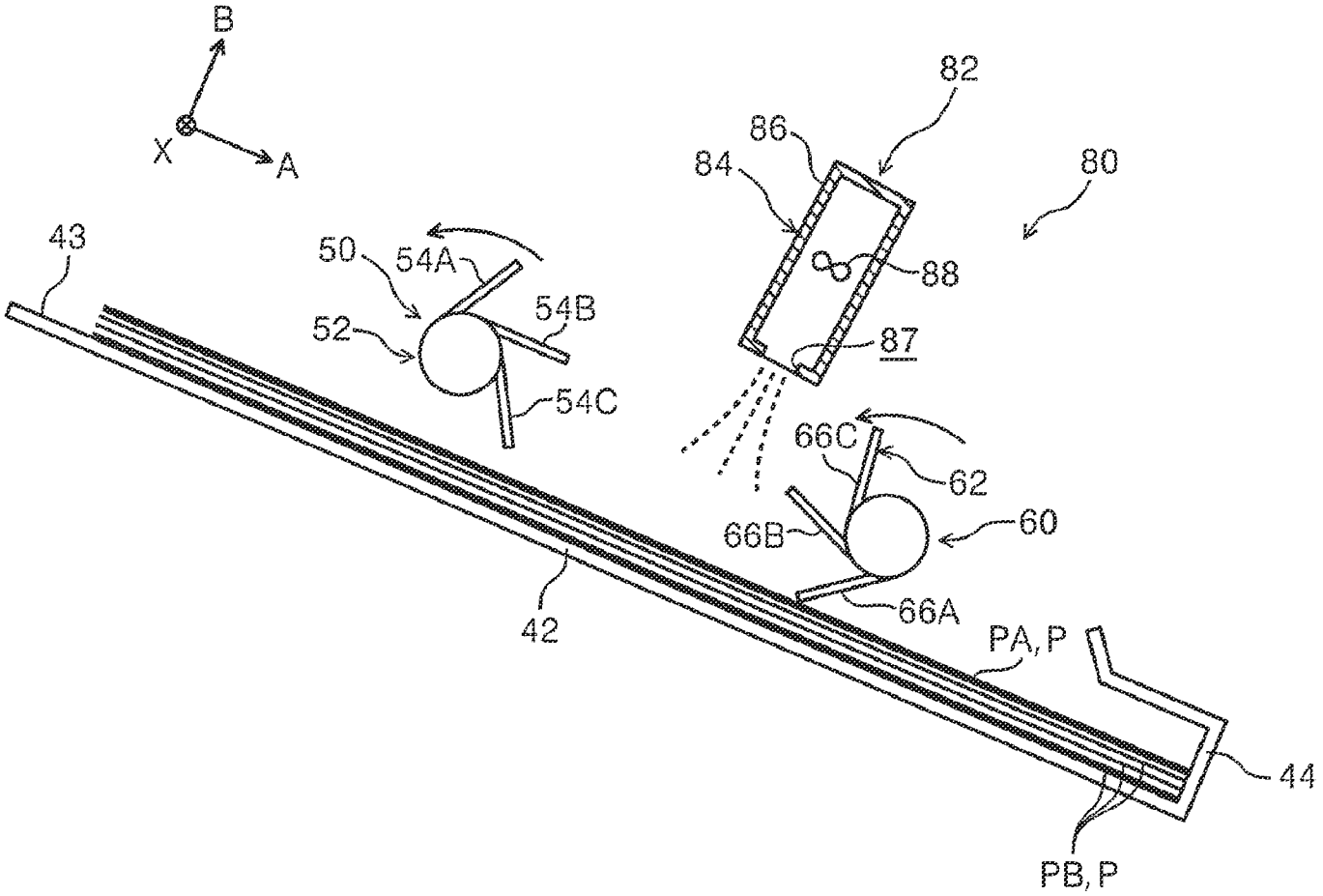
FIG. 14 illustrates a state in which the feeding paddle feeds the sheet toward the aligning section after a pressing section presses the sheet in the post-processing device according to Embodiment 2.

As illustrated in FIG. 14, in a state in which the bulge of the upper sheet PA is reduced or eliminated, the feeding paddle 62 rotates in direction +R. The upper sheet PA is thereby fed toward the aligning plate 44. The end in direction A of the upper sheet PA comes into contact with the aligning plate 44 and is thereby aligned with the end in direction A of the lower sheet PB.

In this manner, according to the post-processing device 80, since the bulge of the sheet P is suppressed, an area in which the feeding section 60 comes into contact with the sheet P is able to be reduced, thus making it possible to suppress an excessive transporting force being applied from the feeding section 60 to the sheet P.

Embodiment 3

Next, a post-processing device 90 of Embodiment 3 will be described with reference to the accompanying drawings. Note that the same parts as those of the post-processing devices 30 and 80 of Embodiments 1 and 2 will be given the same reference numerals, and description thereof will be omitted.

Figure 15:
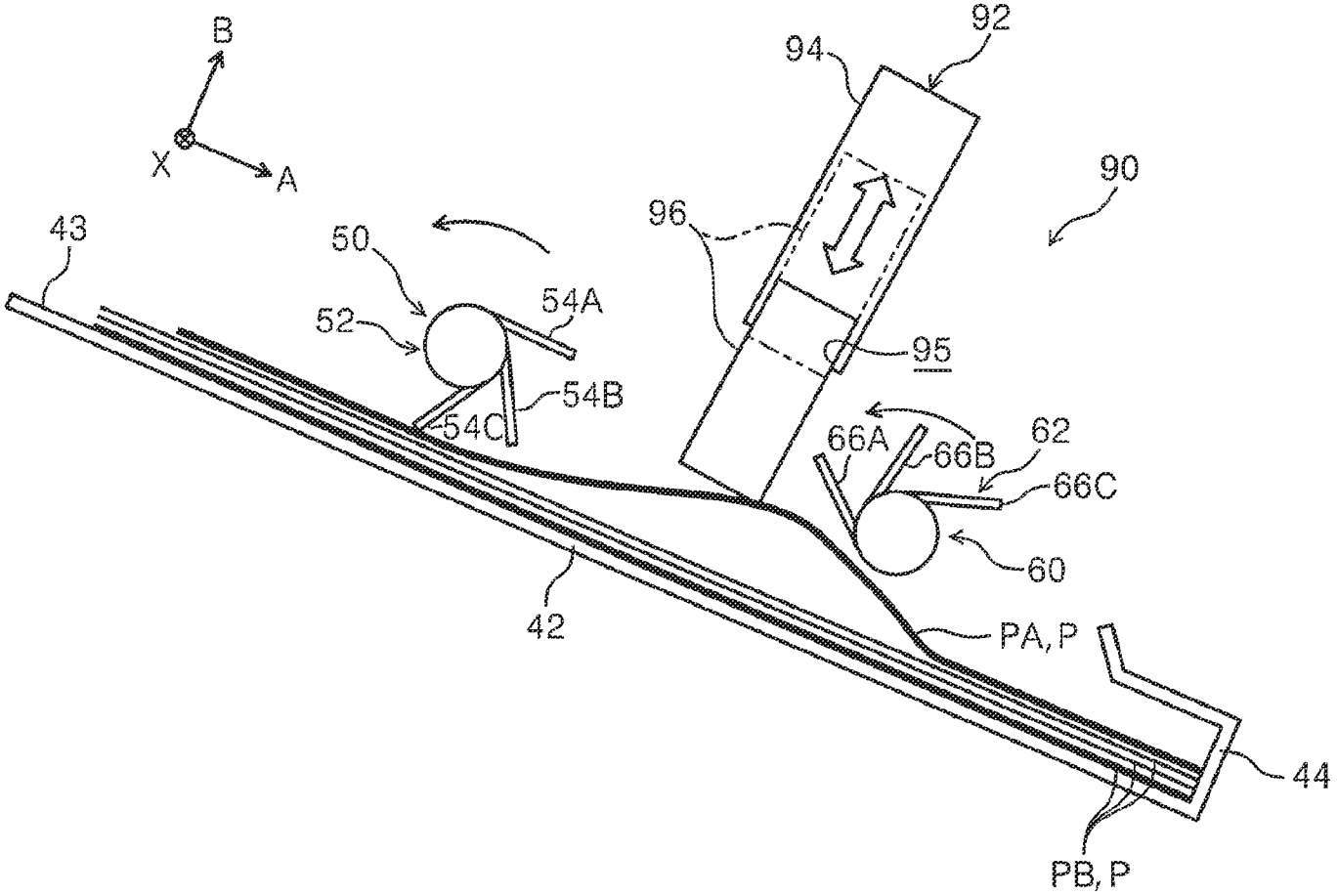
FIG. 15 illustrates a state in which a bulge of the sheet is pressed on the processing tray in a post-processing device according to Embodiment 3.

As illustrated in FIG. 15, the post-processing device 90 of Embodiment 3 is configured such that a pressing section 92 is provided instead of the pressing section 82 (FIG. 13) in the post-processing device 80 (FIG. 13) of Embodiment 2. Components other than the pressing section 92 are similar to those of Embodiment 2.

The pressing section 92 is provided between the transport section 50 and the aligning plate 44 and applies the pressing force having the component in direction −A opposite from direction +A to the sheet P. The pressing section 92 applies the pressing force to the sheet P before the feeding section 60 applies the feeding force to the sheet P.

The pressing section 92 is located in the +Z direction with respect to the sheet P. Moreover, the pressing section 92 is located downstream of the transport paddle 52 in direction +A and upstream of the feeding paddle 62 in direction +A. A distance between the pressing section 92 and the feeding paddle 62 is less than a distance between the pressing section 92 and the transport paddle 52.

Specifically, the pressing section 92 includes a housing 94 having a solenoid (not illustrated) and a plunger 96. For example, two pressing sections 92 are provided with a gap therebetween in the X direction.

The housing 94 extends in direction B when viewed in the X direction. An opening 95 is formed at the end in the direction −B of the housing 94. The opening 95 is open in direction −B toward the sheet P and the processing tray 42.

Switching an energization state of the solenoid (not illustrated) enables the plunger 96 to switch between a state in which the plunger 96 advances in direction −B and a state in which the plunger 96 retreats in direction +B. The plunger 96 is arranged so as to be able to come into contact with a bulged portion of the sheet P when the plunger 96 is in the advancing state.

Next, operation of the post-processing device 90 of Embodiment 3 will be described.

The upper sheet PA starts to move toward the aligning plate 44 by receiving the transporting force from the transport paddle 52. At this time, when the upper sheet PA further receives the transporting force in a state in which the end in direction A of the upper sheet PA is in contact with the aligning plate 44, a portion of the upper sheet PA may bulge in direction +B. Here, when the plunger 96 of the pressing section 92 advances in direction −B and comes into contact with the upper sheet PA, the bulge of the upper sheet PA is reduced or eliminated.

Figure 16:
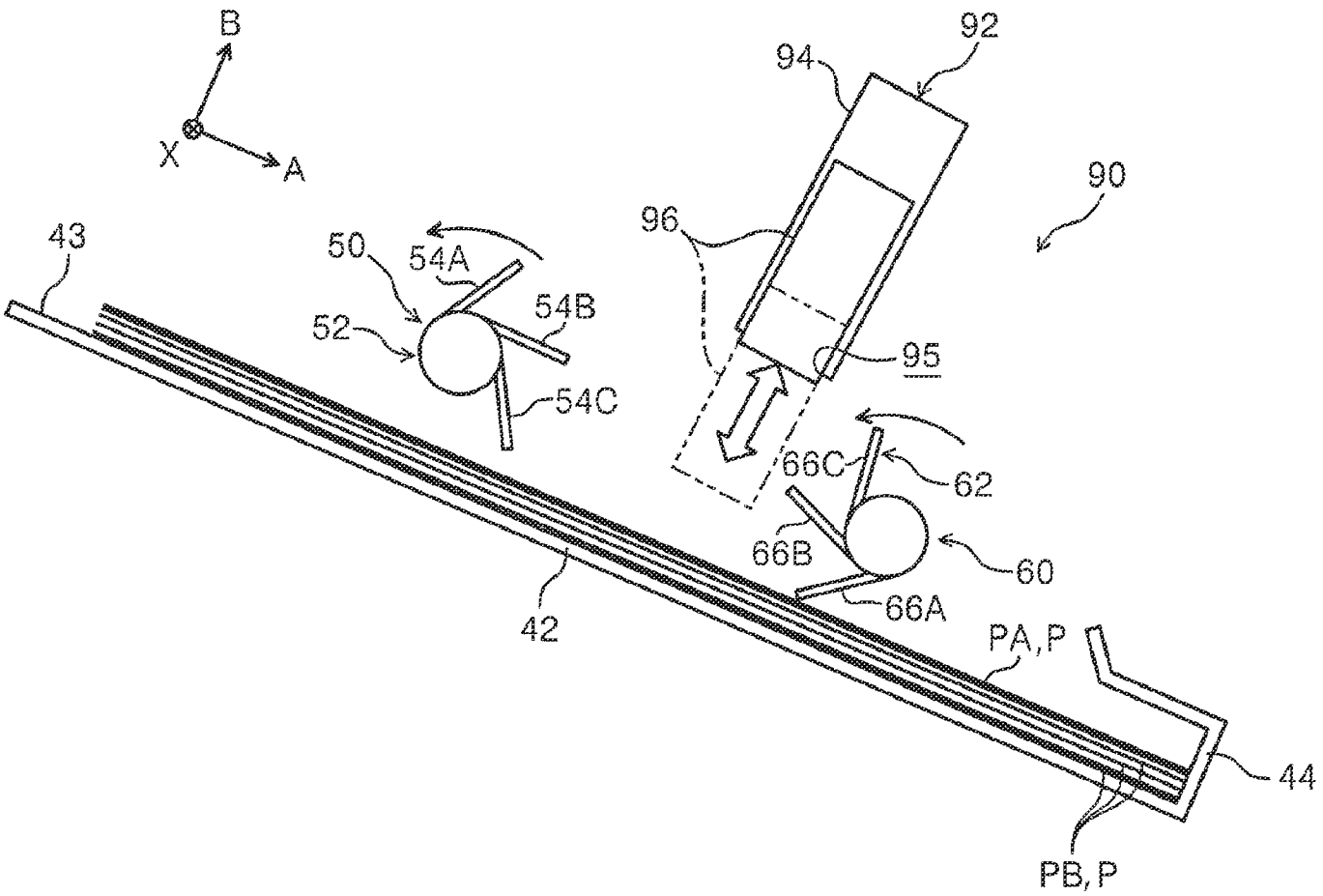
FIG. 16 illustrates a state in which the feeding paddle feeds the sheet toward the aligning section after a pressing section presses the sheet in the post-processing device according to Embodiment 3.

As illustrated in FIG. 16, after a predetermined time has lapsed, the plunger 96 retreats in direction +B. In such a retreat state, the feeding paddle 62 rotates in direction +R.

The upper sheet PA is thereby fed toward the aligning plate 44. The end in direction A of the upper sheet PA comes into contact with the aligning plate 44 and is thereby aligned with the end in direction A of the lower sheet PB.

In this manner, according to the post-processing device 90, since the bulge of the sheet P is suppressed, an area in which the feeding section 60 comes into contact with the sheet P is able to be reduced, thus making it possible to suppress an excessive transporting force being applied from the feeding section 60 to the sheet P.

Although the recording system 1 and the post-processing device 30, 80, or 90 according to Embodiment 1, 2, or 3 of the disclosure basically have the above-described configuration, it is of course possible, for example, to partially change or omit a configuration without departing from the scope of the disclosure of the present application.

Modified Example 1

Figure 17:
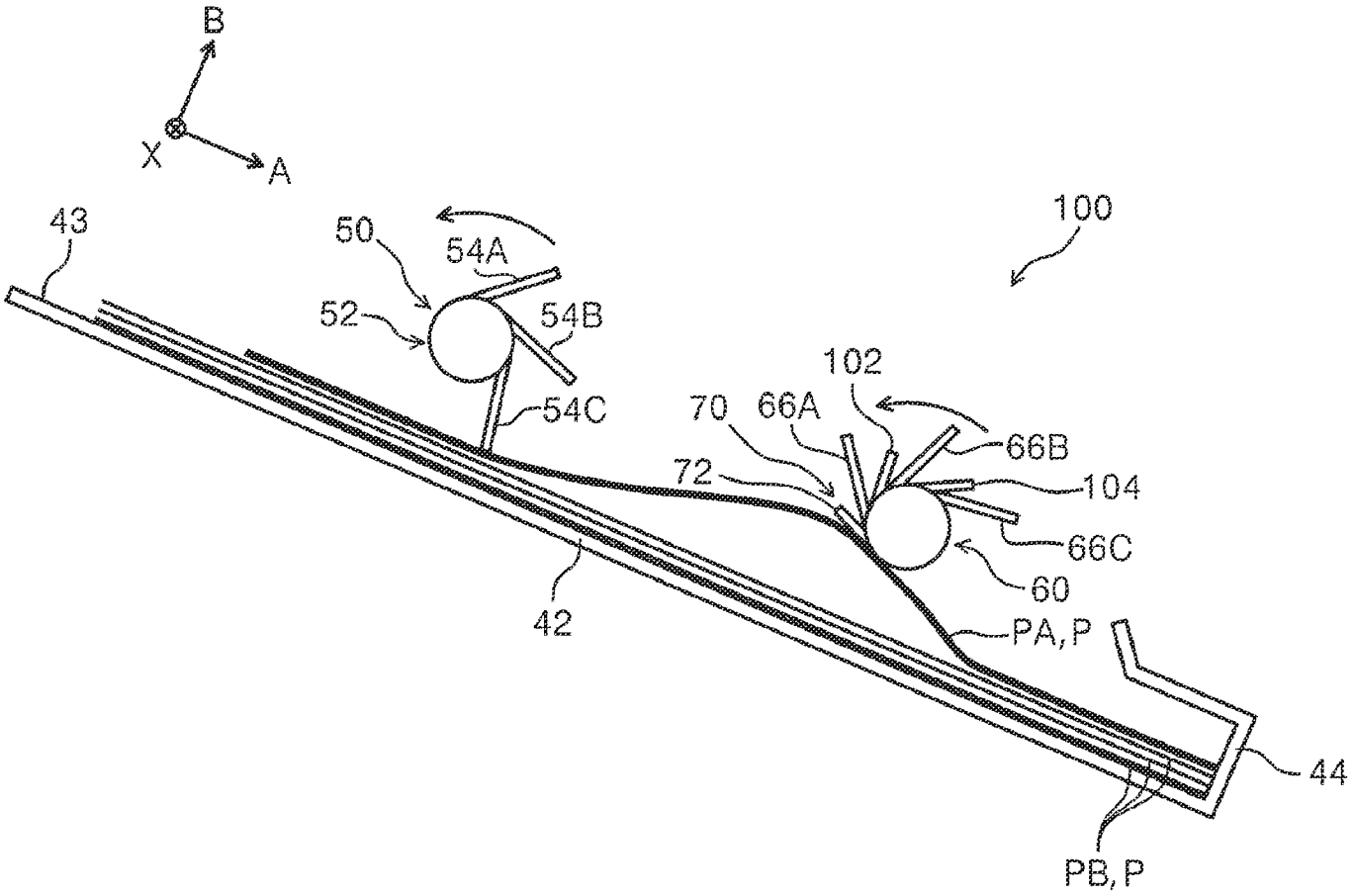
FIG. 17 illustrates a state in which a bulge of the sheet is pressed in a post-processing device according to Modified example 1.

FIG. 17 illustrates a post-processing device 100 of Modified example 1. The post-processing device 100 is configured such that a pressing sheet 102 and a pressing sheet 104 are added to the feeding paddle 62 in the post-processing device 30 (FIG. 3).

The pressing sheet 102 and the pressing sheet 104 are examples of a pressing section and are attached to the rotational shaft 64. The pressing sheet 102 and the pressing sheet 104 are the same as the first pressing sheet 72 (FIG. 5) in size and shape, for example.

When the feeding paddle 62 is viewed in the X direction, the pressing sheet 102 is located between the blade 66A and the blade 66B, and the pressing sheet 104 is located between the blade 66B and the blade 66C. In this manner, the configuration may be such that a plurality of pressing sheets are arranged in the rotational direction of the feeding paddle 62 to perform single pressing before operation of the blade 66A, single pressing before operation of the blade 66B, and single pressing before operation of the blade 66C.

Modified Example 2

Figure 18:
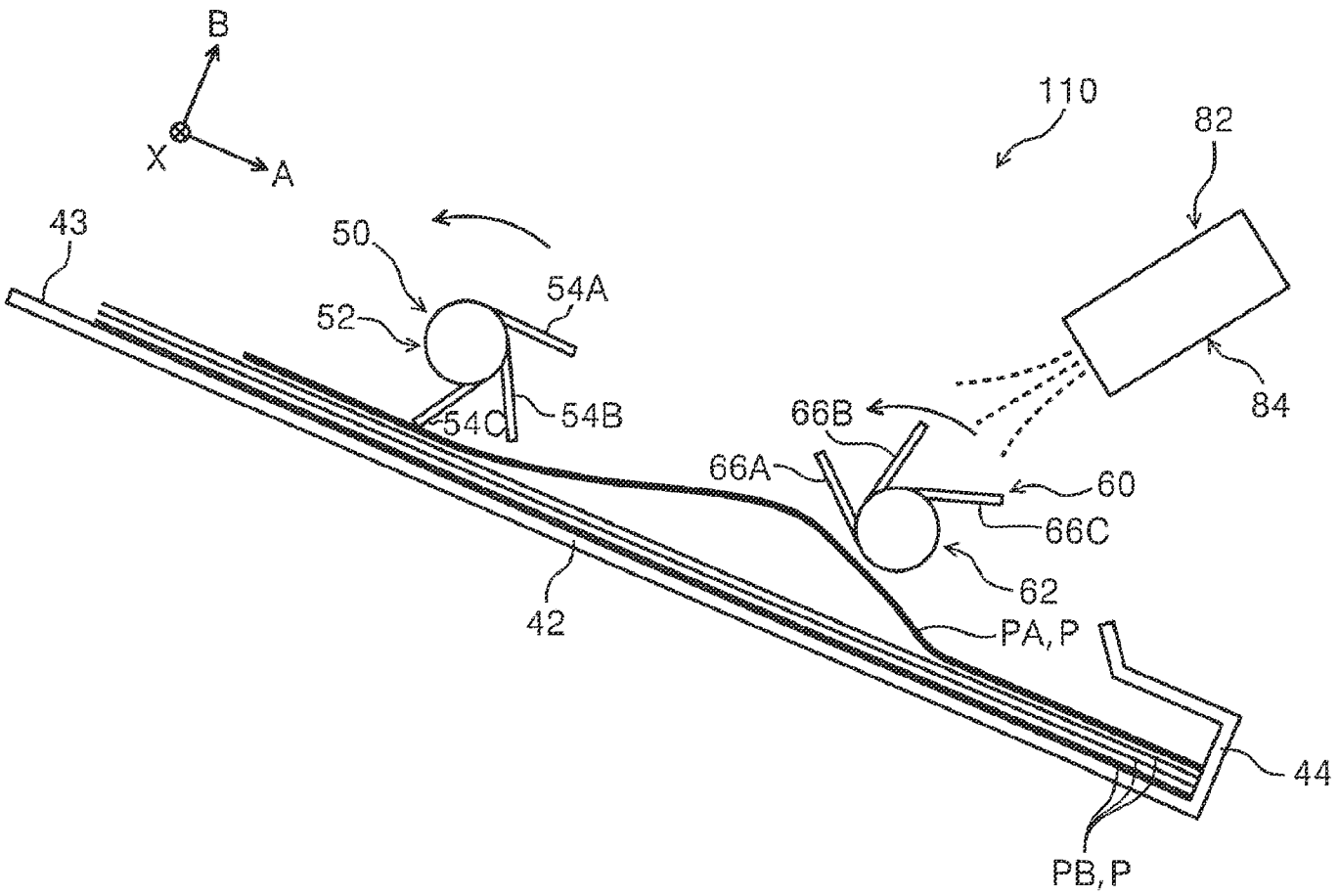
FIG. 18 illustrates a state in which a bulge of the sheet is pressed in a post-processing device according to Modified example 2.

FIG. 18 illustrates a post-processing device 110 of Modified example 2. The post-processing device 110 is configured such that the blower unit 84 is arranged in a different manner compared with that in the post-processing device 80 (FIG. 13).

The blower unit 84 is located downstream of the feeding paddle 62 in direction +A. Moreover, the blower unit 84 blows air onto a portion upstream of the rotational center C of the feeding paddle 62 in direction +A to thereby suppress the bulge of the upper sheet PA. In this manner, even when the blower unit 84 is arranged in a different manner, it is possible to suppress the bulge of the upper sheet PA.

Modified Example 3

Figure 19:
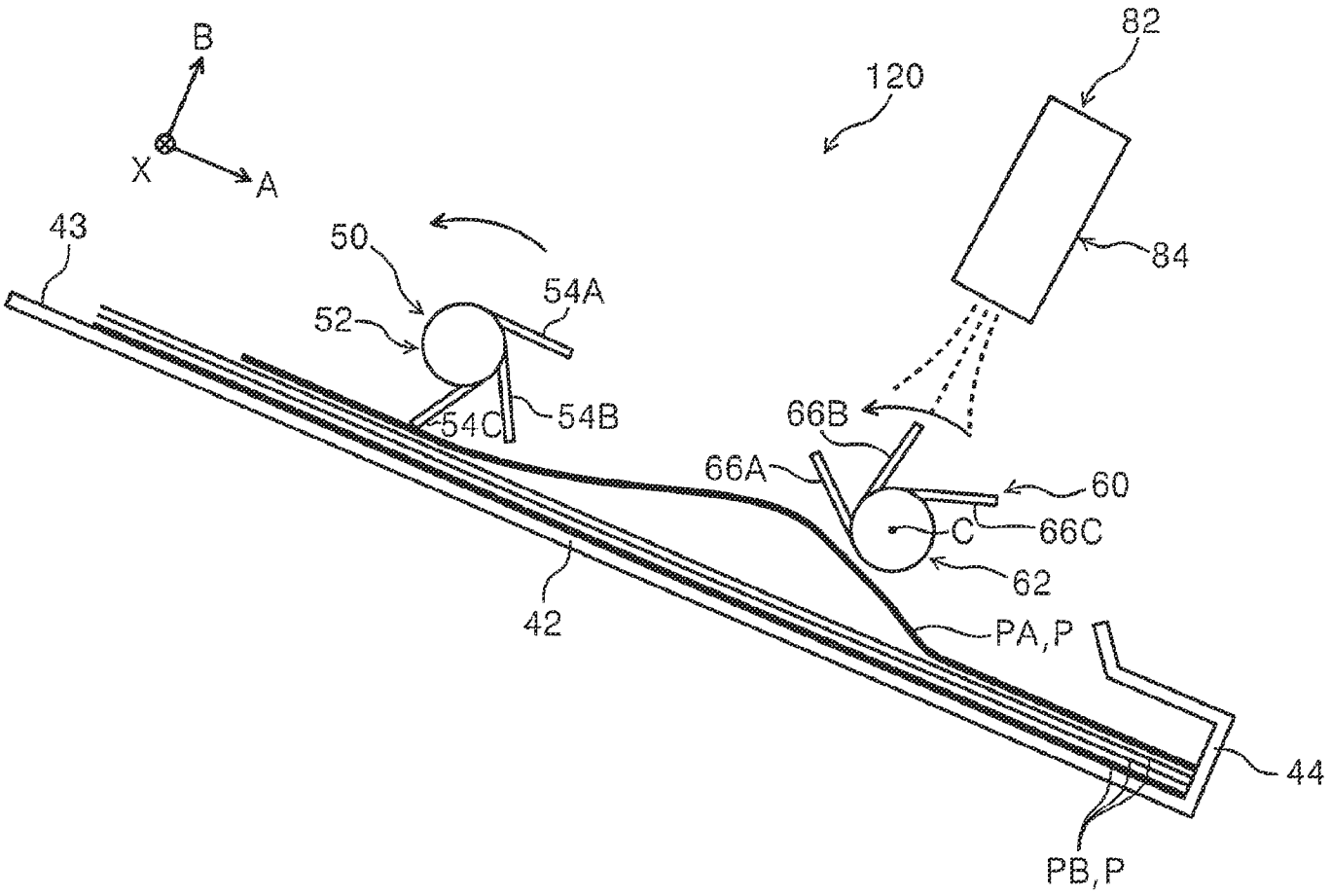
FIG. 19 illustrates a state in which a bulge of the sheet is pressed in a post-processing device according to Modified example 3.

FIG. 19 illustrates a post-processing device 120 of Modified example 3. The post-processing device 120 is configured such that the blower unit 84 is arranged in a different manner compared with that in the post-processing device 80 (FIG. 13).

The blower unit 84 blows air onto the vicinity of the rotational center C of the feeding paddle 62 to thereby suppress the bulge of the upper sheet PA. In this manner, the blower unit 84 may blow air onto a portion of the upper sheet PA, which is located in direction −B with respect to the rotational shaft 64.

Other Modified Examples

In the post-processing device 30, the pressing section 70 may apply the pressing force to a portion of the upper sheet PA, which differs from a portion located below the rotational shaft 64. A portion of the first region S1 and a portion of the second region S2 may be arranged side by side in the X direction. That is, the configuration may be such that at least a portion of the first region S1 and at least a portion of the second region S2 are arranged side by side in the X direction. The second distance LB may be equal to or more than the first distance LA.

In the post-processing device 30, the second frictional coefficient μ2 may be equal to or more than the first frictional coefficient μ1. The second elastic modulus E2 may be equal to or more than the first elastic modulus E1. The pressing section 70 may apply the pressing force to the sheet P when the transport section 50 is in the contact state.

Although three plate sections 54A, 54B, and 54C are provided, the number of plate sections is not limited thereto and may be one, two, or four or more. Similarly, although three blades 66A, 66B, and 66C are provided, the number of blades is not limited thereto and may be one, two, or four or more.

The transport section 50 may include a transport roller instead of the transport paddle 52.

The post-processing device 30, 80, 90, 100, 110, or 120 may include a separate control section different from the control section 24.

When the first pressing sheet 72 and the second pressing sheet 74 apply the pressing force having a component in the direction −A to the upper sheet PA, the transport paddle 52 may be in the contact state.

Also in such an instance, since the bulge retreats in direction −A when being pressed by the first pressing sheet 72 and the second pressing sheet 74, it is possible to reduce a possible increase in the area in which the feeding paddle 62 comes into contact with the upper sheet PA. Thus, it is possible to reduce possible application of an excessive transporting force to the upper sheet PA by the feeding paddle 62 and reduce deterioration of alignment of sheets P on the processing tray 42.

What is claimed is:

1. A post-processing device comprising:

a mounting section on which a medium before being subjected to post-processing by a post-processing section is to be mounted;

an aligning section that aligns ends of a plurality of media stacked on the mounting section;

a transport section that transports the medium on the mounting section toward the aligning section in a transport direction;

a feeding section that is provided between the transport section and the aligning section and feeds the medium in the transport direction; and a pressing section that is provided between the transport section and the aligning section, applies, to the medium, a pressing force having a component in a direction opposite from the transport direction, and applies the pressing force to the medium before the feeding section applies a feeding force to the medium; and a controller configured to control a rotational shaft of the feeding section, wherein the controller controls the rotational shaft of the feeding section to cause the pressing section to apply the pressing force to a top planar surface of the medium.

2. The post-processing device according to claim 1, wherein the rotational shaft extends in a medium-width direction intersecting the transport direction, and the pressing section applies the pressing force to a portion of an upper medium uppermost in a stacking direction of the plurality of media, the portion being located below the rotational shaft in the stacking direction.

3. The post-processing device according to claim 2, wherein at least a portion of a second region of the medium, in which the pressing force acts, and at least a portion of a first region of the medium, in which the feeding force acts, are arranged side by side in the medium-width direction when viewed from top to bottom in the stacking direction.

4. The post-processing device according to claim 2, wherein the feeding section includes a first blade section that extends from an outer circumferential surface of the rotational shaft, the pressing section includes a second blade section that extends from the outer circumferential surface of the rotational shaft, and a second distance from a rotational center of the rotational shaft to a tip end of the second blade section is less than a first distance from the rotational center to a tip end of the first blade section when viewed in the medium-width direction.

5. The post-processing device according to claim 4, wherein the pressing section performs a pressing operation of applying the pressing force to the medium by being rotated in a first direction when viewed in the medium-width direction and retreats from the medium by being rotated in a second direction opposite from the first direction after the pressing operation and before the feeding section applies the feeding force to the medium.

6. The post-processing device according to claim 2, wherein a second frictional coefficient at a position at which the pressing section is in contact with the medium is lower than a first frictional coefficient at a position at which the feeding section is in contact with the medium.

7. The post-processing device according to claim 2, wherein a second elastic modulus of the pressing section is lower than a first elastic modulus of the feeding section.

8. The post-processing device according to claim 1, wherein the feeding section performs a feeding operation for the medium in a state in which the pressing section applies the pressing force to the medium.

9. The post-processing device according to claim 1, wherein the transport section is configured to switch between a contact state in which the transport section is in contact with the medium and a retreat state in which the transport section is retreated from the medium, and when the pressing section applies the pressing force to the medium, the transport section retreats to the retreat state.

10. The post-processing device according to claim 1, wherein the rotational shaft extends in a medium-width direction intersecting the transport direction, the feeding section includes a first blade section that extends from an outer circumferential surface of the rotational shaft, the pressing section includes a second blade section that extends from the outer circumferential surface of the rotational shaft, and a second distance from a rotational center of the rotational shaft to a tip end of the second blade section is less than a first distance from the rotational center to a tip end of the first blade section when viewed in the medium-width direction.

11. The post-processing device according to claim 1, wherein the pressing section applies the pressing force to the top planer surface of the medium so to at least partially remove any bulges in the medium.

12. A post-processing device comprising:

a mounting section on which a medium before being subjected to post-processing by a post-processing section is to be mounted;

an aligning section that aligns ends of a plurality of media stacked on the mounting section;

a transport section that transports the medium on the mounting section toward the aligning section in a transport direction;

a feeding section that is provided between the transport section and the aligning section and feeds the medium in the transport direction by rotating about a rotational shaft;

a controller configured to control the rotational shaft; and a pressing section that is provided between the transport section and the aligning section and, by rotating about the rotational shaft in a rotational direction identical to a rotational direction of the feeding section, applies, to the medium, a pressing force having a component in a direction opposite from the transport direction, wherein the pressing section is provided at a position preceding the feeding section in the rotational direction, and wherein the controller controls the rotational shaft to cause the pressing section to apply the pressing force to a top planar surface of the medium.

13. The post-processing device according to claim 12, wherein the rotational shaft extends in a medium-width direction intersecting the transport direction, the feeding section includes a first blade section that extends from an outer circumferential surface of the rotational shaft, the pressing section includes a second blade section that extends from the outer circumferential surface of the rotational shaft, and a second distance from a rotational center of the rotational shaft to a tip end of the second blade section is less than a first distance from the rotational center to a tip end of the first blade section when viewed in the medium-width direction.

14. The post-processing device according to claim 12, wherein the rotational shaft extends in a medium-width direction intersecting the transport direction, and the pressing section applies the pressing force to a portion of an upper medium uppermost in a stacking direction of the plurality of media, the portion being located below the rotational shaft in the stacking direction.

15. The post-processing device according to claim 12, wherein the pressing section applies the pressing force to the top planer surface of the medium so to at least partially remove any bulges in the medium.

16. A post-processing device comprising:

a mounting section on which a medium before being subjected to post-processing by a post-processing section is to be mounted;

an aligning section that aligns an end of a plurality of media stacked on the mounting section;

a transport section that transports the medium on the mounting section toward the aligning section in a transport direction;

a feeding section that is provided between the transport section and the aligning section and feeds the medium in the transport direction;

a pressing section that is provided between the transport section and the aligning section, applies, to the medium, a pressing force having a component in a direction opposite from the transport direction, and applies the pressing force to the medium before the feeding section applies a feeding force to the medium; and a controller configured to control the pressing section, wherein the controller controls the pressing section to cause the pressing section to apply the pressing force to the medium after an end of the medium reaches the aligning section.

17. The post-processing device according to claim 16, wherein the controller controls the pressing section to cause the pressing section to apply the pressing force to the medium so to at least partially remove any bulges in the medium.

18. A post-processing device comprising:

a mounting section on which a medium before being subjected to post-processing by a post-processing section is to be mounted;

an aligning section that aligns an end of a plurality of media stacked on the mounting section;

a transport section that transports the medium on the mounting section toward the aligning section in a transport direction;

a feeding section that is provided between the transport section and the aligning section and feeds the medium in the transport direction by rotating about a rotational shaft;

a controller configured to control the rotational shaft; and a pressing section that is provided between the transport section and the aligning section and, by rotating about the rotational shaft in a rotational direction identical to a rotational direction of the feeding section, applies, to the medium, a pressing force having a component in a direction opposite from the transport direction, wherein the pressing section is provided at a position preceding the feeding section in the rotational direction, and wherein the controller controls the rotational shaft to cause the pressing section to apply the pressing force to the medium after an end of the medium reaches the aligning section.

19. The post-processing device according to claim 18, wherein the controller controls the rotational shaft to cause the pressing section to apply the pressing force to the medium so to at least partially remove any bulges in the medium.

* * * * *